US008961157B2

(12) United States Patent
Iijima

(10) Patent No.: US 8,961,157 B2
(45) Date of Patent: Feb. 24, 2015

(54) VANE PUMP

(71) Applicant: Hitachi Automotive Systems, Ltd., Hitachinaka-shi, Ibaraki (JP)

(72) Inventor: Masaaki Iijima, Maebashi (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 226 days.

(21) Appl. No.: 13/767,444

(22) Filed: Feb. 14, 2013

(65) Prior Publication Data

US 2013/0251571 A1 Sep. 26, 2013

(30) Foreign Application Priority Data

Mar. 22, 2012 (JP) ..... 2012-065154

(51) Int. Cl.

| | |
|---|---|
| ***F03C 2/00*** | (2006.01) |
| ***F01C 1/00*** | (2006.01) |
| ***F04C 2/00*** | (2006.01) |
| ***F01C 21/08*** | (2006.01) |
| ***F04C 2/344*** | (2006.01) |
| ***F04C 14/22*** | (2006.01) |

(52) U.S. Cl.

CPC ..... *F04C 2/00* (2013.01); *F01C 21/0836* (2013.01); *F04C 2/344* (2013.01); *F04C 14/226* (2013.01)

USPC ..... 418/29; 418/82; 418/268

(58) Field of Classification Search

CPC ..... F04C 14/226; F04C 2/344; F04C 2/00; F01C 21/0836

USPC ..... 418/29, 82, 244, 260, 268, 269, 24–27

See application file for complete search history.

(56) References Cited

U.S. PATENT DOCUMENTS

| | | | | |
|---|---|---|---|---|
| 4,242,068 | A * | 12/1980 | Shaw | 418/269 |
| 4,374,632 | A * | 2/1983 | Wilcox | 418/267 |
| 4,913,636 | A * | 4/1990 | Niemiec | 418/82 |
| 6,481,990 | B2 * | 11/2002 | Wong et al. | 418/82 |
| 7,070,399 | B2 * | 7/2006 | Konishi et al. | 417/410.3 |
| 7,247,008 | B2 * | 7/2007 | Clements et al. | 418/30 |

FOREIGN PATENT DOCUMENTS

JP 3631264 B2 12/2004

* cited by examiner

*Primary Examiner* — Hoang Nguyen
(74) *Attorney, Agent, or Firm* — Crowell & Moring LLP

(57) ABSTRACT

A vane pump includes a plurality of vanes and a vane cam. Each of the vanes is housed in a corresponding one of multiple slits in an outer periphery of a rotor in a manner of being capable of protruding from, and retracting in, the slit. Each of the vanes has both end faces formed into curved surfaces in a plane perpendicular to a rotational axis of the rotor. The vane cam is disposed in contact with an end portion of the rotor such that an outer peripheral surface thereof contacts inner peripheral side end portions of all vanes to thereby forcedly make the vanes protrude and retract. The vane cam is movable so as to vary an amount of eccentricity relative to a drive shaft.

8 Claims, 8 Drawing Sheets

| APPROACH | PRESSURE AROUND VANE CAM | VANE CAM ACTION | | EFFECT ON DRIVE TORQUE |
|---|---|---|---|---|
| | | RADIAL | AXIAL | |
| 1 | SUCTION PRESSURE (SUCTION AREA) AND DISCHARGE PRESSURE (DISCHARGE AREA) | C | $A^+$ | A |
| 2 | SUCTION PRESSURE (ENTIRE PERIPHERY) | B | (C) | A |
| 3 | INTERMEDIATE PRESSURE (ENTIRE PERIPHERY) | A | B | C |
| 4 | DISCHARGE PRESSURE (ENTIRE PERIPHERY) | $A^+$ | C | C |

VANE PUMP

BACKGROUND OF THE INVENTION

1. Field of the Invention

The present invention relates to a vane pump.

2. Description of Related Art

JP 3631264 B discloses a technique for a vane pump having arrangements in which two circularly arcuate groove portions are formed at portions corresponding to proximal ends of vane housing slit grooves in a rotor and associated with a suction side zone and a discharge side zone of a pump chamber, fluid pressures of the suction side and the discharge side of the pump being introduced to the two groove portions.

SUMMARY OF THE INVENTION

In the vane pump disclosed in JP 3631264 B, pressure of a fluid introduced to the circularly arcuate groove and a centrifugal force associated with rotation of the rotor cause the vane to protrude from the vane housing slit groove and a distal end of the vane to abut on an inner periphery of a cam ring. However, during rotation of the rotor at low speed, the vane protrudes insufficiently due to a small centrifugal force, so that the distal end of the vane may be spaced apart from the inner periphery of the cam ring. If, at this time, the proximal end of the vane housing slit groove is disposed at the circularly arcuate groove to which the fluid pressure on the discharge side is introduced, a high working fluid pressure on the discharge side flows into the vane housing slit groove to thereby cause the vane to burst to collide with the inner periphery of the cam ring, thus generating a large impact noise.

The present invention has been made to solve the foregoing problem and it is an object of the present invention to provide a vane pump that can cause a vane to protrude sufficiently even during rotation of a rotor at low speed, to thereby prevent the vane from colliding with an inner periphery of a cam ring and to reduce noise.

To achieve the foregoing object, an aspect of the present invention provides a vane pump comprising a plurality of vanes, each of the vanes being housed in a corresponding one of multiple slits in an outer periphery of a rotor in a manner of being capable of protruding from, and retracting in, the slit and having both end faces formed into curved surfaces in a plane perpendicular to a rotational axis of the rotor; and a vane cam disposed in contact with an end portion of the rotor such that an outer peripheral surface thereof contacts inner peripheral side end portions of all vanes to thereby forcedly make the vanes protrude and retract, the vane cam being movable so as to vary an amount of eccentricity relative to a drive shaft.

The vane can be made to protrude sufficiently even during rotation of the rotor at low speed. Further, the clearance between the vane and the cam ring is reduced and collision between the vane and the cam ring inner periphery is controlled, so that noise can be reduced.

BRIEF DESCRIPTION OF THE DRAWINGS

The present invention will be described hereinafter with reference to the accompanying drawings.

DESCRIPTION OF THE PREFERRED EMBODIMENTS

First Embodiment

[General Arrangements of Vane Pump]

A vane pump 1 is used as an automotive hydraulic device, specifically, a source for supplying a belt-type continuously variable transmission (CVT 100) with hydraulic pressure.

The vane pump 1 is driven by a crankshaft of an internal combustion engine and draws a working fluid therein and discharges the working fluid therefrom. A hydraulic fluid, specifically, an automatic transmission fluid (ATF) is used for the working fluid.

This is, however, not to intend to limit the present invention and the present invention may be applied to a vane pump that supplies any mechanism other than the CVT the hydraulic fluid.

Figure 1:
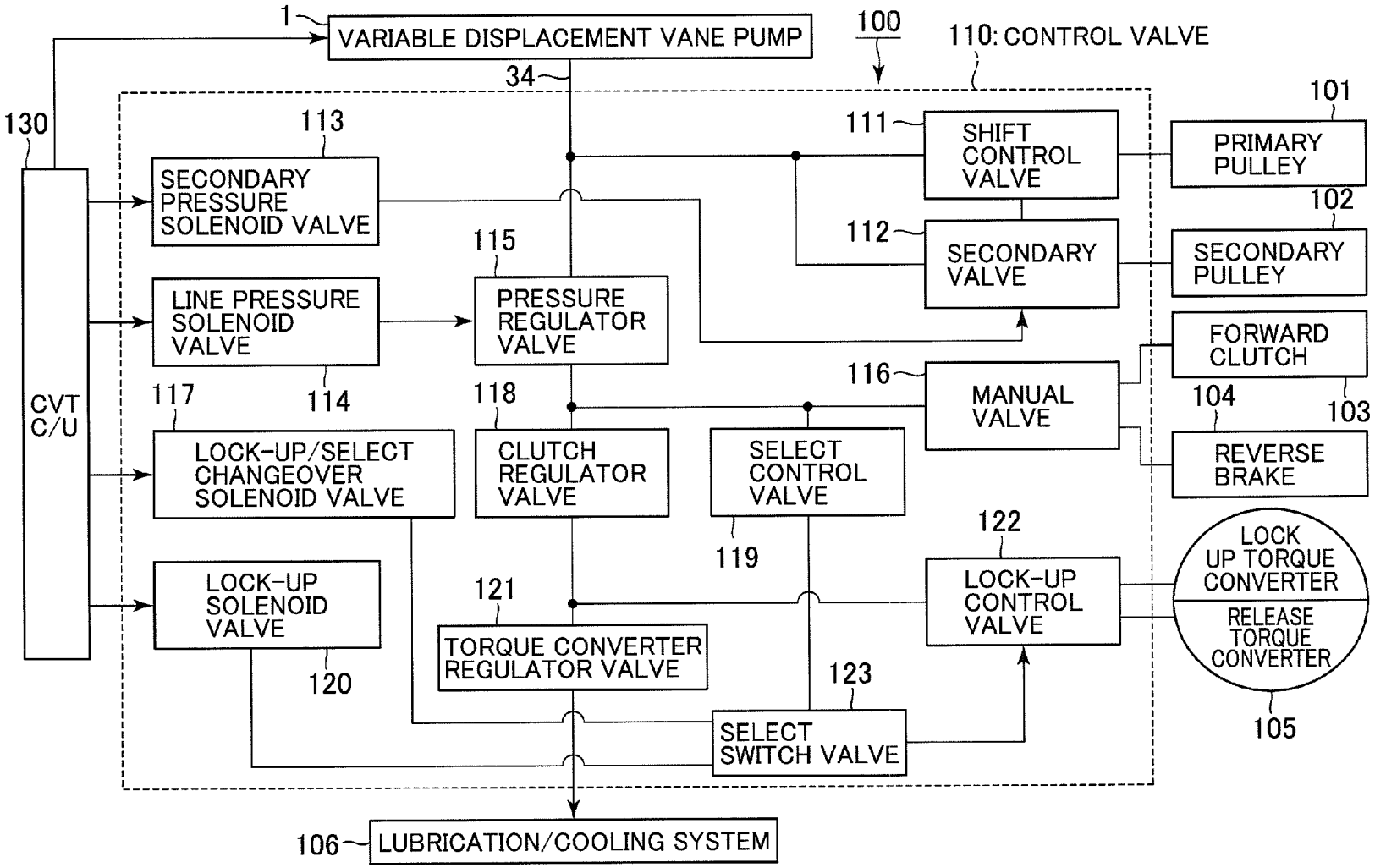
FIG. 1 is a block diagram showing a continuously variable transmission (CVT) to which a vane pump according to a first embodiment of the present invention is applied.

FIG. 1 is a block diagram showing an exemplary CVT 100. Various types of valves (a shift control valve 111, a secondary valve 112, a secondary pressure solenoid valve 113, a line pressure solenoid valve 114, a pressure regulator valve 115, a manual valve 116, a lock-up/select changeover solenoid valve 117, a clutch regulator valve 118, a select control valve 119, a lock-up solenoid valve 120, a torque converter regulator valve 121, a lock-up control valve 122, and a select switch valve 123) controlled by a CVT control unit 130 are disposed inside a control valve 110. The hydraulic fluid discharged from the vane pump 1 is supplied to different parts (a primary pulley 101, a secondary pulley 102, a forward clutch 103, a reverse brake 104, a torque converter 105, and a lubrication and cooling system 106) via the control valve 110.

Figure 2:
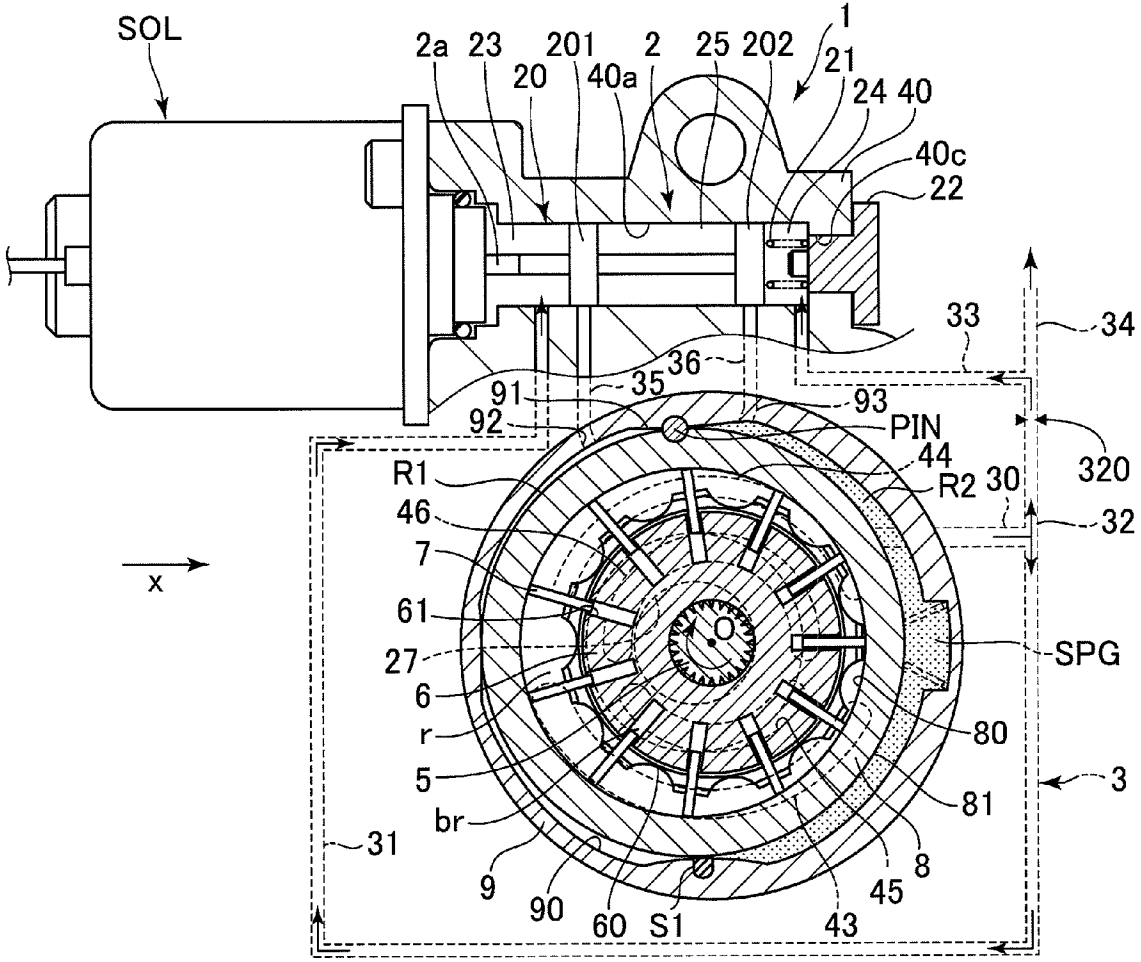
FIG. 2 is a cross-sectional view showing an inside of the vane pump according to the first embodiment of the present invention, as viewed from a rotating axial direction.
Figure 3:
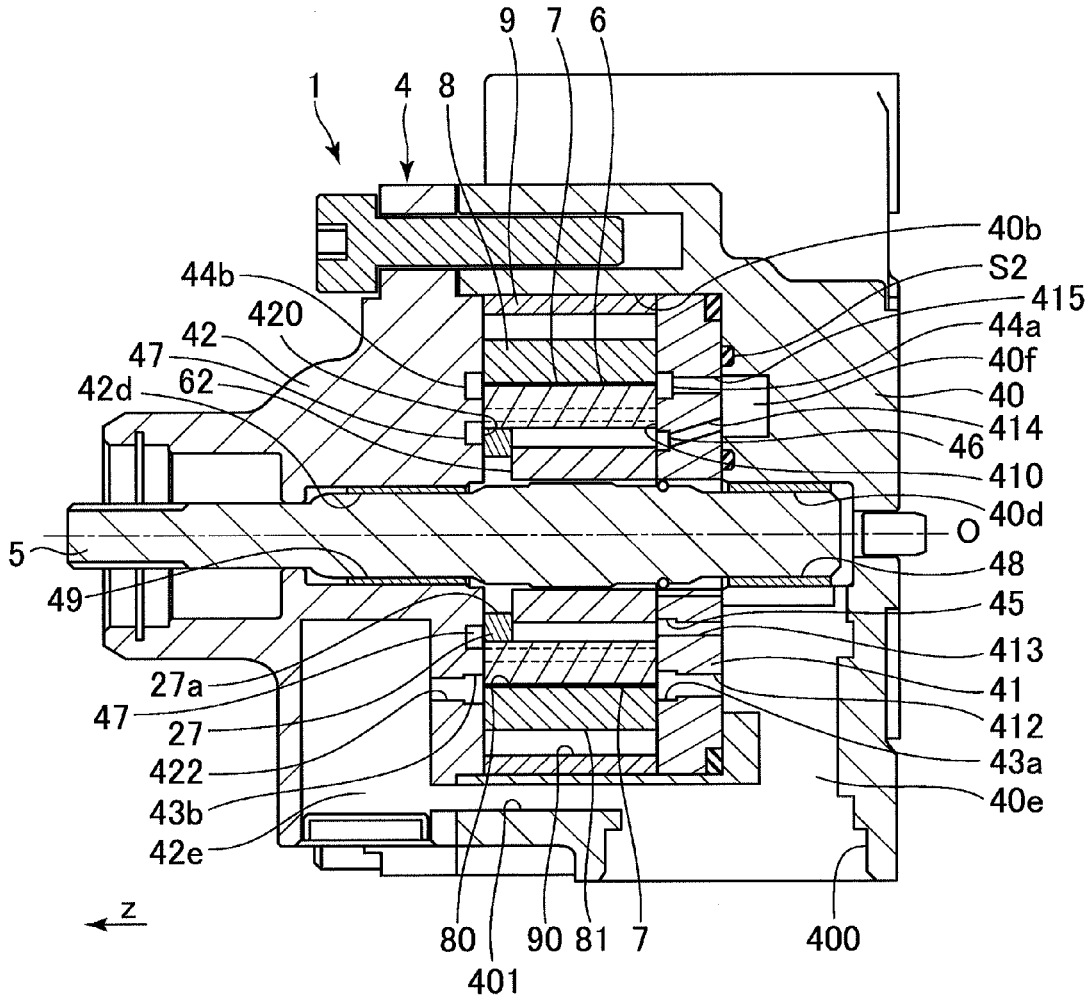
FIG. 3 is a cross-sectional view showing the inside of the vane pump according to the first embodiment of the present invention, as viewed from a radial direction of the rotating axis.

The vane pump 1 is a variable displacement type that can vary pump displacement (an amount of fluid discharged per one revolution). The vane pump 1 includes a pump unit and a control unit as an integral unit housed inside a pump body as a housing. Specifically, the pump unit draws and discharges the hydraulic fluid. The control unit controls the pump displacement. FIGS. 2 and 3 show partial cross sections of the vane pump 1. FIG. 2 is a cross section of the pump unit excluding a pump body 4, taken along a plane perpendicular to a rotational axis 0. FIG. 2 also shows a partial cross section of the control unit, taken along a plane that passes through an axis of a control valve 2. FIG. 3 is a cross section of the pump unit including the pump body 4, taken along a plane that passes through the rotational axis 0. For convenience sake, an x-axis is taken in a direction in which the axis of the control valve 2 extends and the x-axis is positive on the side on which a valve element (a spool 20) is spaced away from a solenoid SOL. Additionally, a z-axis is defined to extend in a direction in which the rotational axis 0 of the vane pump 1 extends and the z-axis is positive upwardly relative to a paper surface of FIG. 2.

(Arrangements of Pump Unit)

The pump unit mainly includes a drive shaft (a rotational axis) 5, a rotor 6, vanes 7, a cam ring 8, and an adapter ring 9. Specifically, the drive shaft 5 is driven by the crankshaft. The rotor 6 is rotatably driven by the drive shaft 5. Each of the vanes 7 is housed in a corresponding one of multiple slits 61 formed in an outer periphery of the rotor 6 in a manner of being capable of protruding from, and retracting in, the slit 61. The cam ring 8 is disposed to surround the rotor 6. The adapter ring 9 is disposed to surround the cam ring 8.

The pump body 4 mainly includes a rear body 40, a pressure plate 41, and a front body 42. Specifically, the rear body 40 has a housing recess 40*b* in which the rotor 6, the vanes 7, and the cam ring 8 are housed. The pressure plate 41 is housed in a bottom portion on a side in the negative z-axis direction of the housing recess 40*b* in the rear body 40 and disposed on the side in the negative z-axis direction of the cam ring 8 and the rotor 6. The pressure plate 41 forms a plurality of pump chambers r with the rotor 6, the vanes 7, and the cam ring 8. The front body 42 closes an opening of the housing recess 40*b*. The front body 42 is disposed on the side in the positive z-axis direction of the cam ring 8 and the rotor 6. The front body 42 forms the pump chambers r with the rotor 6, the vanes 7, and the cam ring 8.

The drive shaft 5 is rotatably journaled on the pump body 4 (the rear body 40, the pressure plate 41, and the front body 42). The drive shaft 5 has an end on the side in the positive z-axis direction connected to the crankshaft of the internal combustion engine via a chain, rotating in time with the crankshaft. The rotor 6 is coaxially fixed (serration connection) to an outer periphery of the drive shaft 5. The rotor 6 rotates with the drive shaft 5 clockwise in FIG. 2 about the rotational axis 0.

The housing recess 40*b* formed in the rear body 40 has a closed-bottom cylindrical shape extending in the z-axis direction. The adapter ring 9 having a circular ring shape is disposed on an inner periphery of the housing recess 40*b*. The adapter ring 9 has an inner peripheral surface that forms a substantially cylindrical housing hole 90 extending in the z-axis direction. The cam ring 8 having an annular ring shape is oscillatably housed in the housing hole 90. A coil spring SPG as an elastic member has a first end disposed on the side in the positive x-axis direction of the adapter ring 9 and a second end disposed on the side in the positive x-axis direction of the cam ring 8. The coil spring SPG is mounted in a compressed state, urging at all times the cam ring 8 toward the side in the negative x-axis direction relative to the adapter ring 9.

A pin PIN that locks the adapter ring 9 and the cam ring 8 in position is disposed between the adapter ring 9 and the cam ring 8 so as to be clamped between a recess in an inner peripheral surface (a rolling surface 91) of the adapter ring 9 and a recess in an outer peripheral surface (a cam ring outer peripheral surface 81) of the cam ring 8. The pin PIN has both ends fixedly disposed in the pump body 4. The cam ring 8 is supported relative to the adapter ring 9 on the rolling surface 91 on which the pin PIN is disposed, and pivotally oscillatable about the rolling surface 91. The pin PIN prevents the cam ring 8 from being deviated (relative rotation) relative to the adapter ring 9. A sealing member S1 is disposed on the inner peripheral surface of the adapter ring 9 (in the housing hole 90) at a position substantially opposite to the pin PIN across the rotational axis 0.

When the cam ring 8 oscillates, the rolling surface 91 of the adapter ring 9 abuts on the cam ring outer peripheral surface 81 and the sealing member S1 slidably contacts the cam ring outer peripheral surface 81. Let δ be an amount of eccentricity of the cam ring 8 relative to the rotational axis 0. Then, the amount of eccentricity δ is minimum (zero) at a position at which a central axis of the cam ring 8 is aligned with the rotational axis 0 (a minimum eccentric position) and maximum at a position shown in FIG. 2 in which the cam ring outer peripheral surface 81 abuts on the inner peripheral surface of the adapter ring 9 (housing hole 90) on the side in the negative x-axis direction.

The rotor 6 is disposed on the inner peripheral side of the cam ring 8. The rotor 6 has a plurality of grooves (slits 61) formed radially. As viewed from the z-axis direction, each of the slits 61 is disposed linearly to extend in a rotor radial direction to a predetermined depth toward the rotational axis 0 from a rotor outer peripheral surface 6*a*. The slits 61 are formed to extend over an entire range in the z-axis direction of the rotor 6. The slits 61 are formed at 11 positions, each being equally spaced apart from each other circumferentially. A back pressure chamber br extending in the z-axis direction is formed at a proximal end portion on the inner peripheral side (the side toward the rotational axis 0) of each slit 61. The back pressure chamber br is formed into a groove similar to that of each slit 61.

The vane 7 is a plate member having a substantially rectangular shape. One vane 7 is housed in each of the slits 61 in a manner of being capable of protruding from, and retracting in, the slit 61. It is noted that the number of slits 61 or vanes 7 is not limited to 11. The shape of the vane 7 will be described in detail later.

A circular recess 62 having an axial depth is formed on the side in the positive z-axis direction of the rotor 6. The circular recess 62 has an inside diameter of a circle formed by connecting proximal end portions of the vanes 7 when the vanes 7 protrude most from the slits 61.

A ring-shaped vane cam 27 having a through hole 27*a* is housed in the circular recess 62. The vane cam 27 has an outside diameter that is equal to a diameter of an inner peripheral surface of the cam ring 8 (cam ring inner peripheral surface 80) less a value doubling a length of the vane 7. Specifically, the vane cam 27 is eccentric together with the cam ring 8 and has an outer peripheral surface (vane cam outer peripheral surface 27*b*) formed to be in contact with the proximal end portions of all vanes 7 at all times.

The vane cam 27 is formed to have an axial thickness that is substantially equal to the depth of the circular recess 62. The drive shaft 5 is passed through the through hole 27*a*. The through hole 27*a* has an inside diameter formed so as not to be in contact with the drive shaft 5 when the vane cam 27 is eccentric most and so as to be on the inner peripheral side relative to a proximal end portion of the back pressure chamber br. Specifically, the foregoing ensures that the proximal end portion of the back pressure chamber br can be sealed even when the vane cam 27 is eccentric most.

An annular chamber formed among the outer peripheral surface of the rotor 6 (rotor outer peripheral surface 6*a*), the cam ring inner peripheral surface 80, a positive z-axis direction side surface 410 of the pressure plate 41, and a negative z-axis direction side surface 420 of the front body 42 is partitioned into 11 pump chambers r by the multiple vanes 7. Hereinafter, a distance between adjacent vanes 7 (between side surfaces of two adjacent vanes 7) in a rotating direction of the rotor 6 (in the clockwise direction in FIG. 2; to be hereinafter referred to simply as the "rotating direction" and a backward rotating direction of the rotor 6 will be referred to as a "negative rotating direction") will be referred to as "1 pitch". A width in the rotating direction of one pump chamber r is 1 pitch and invariant.

When a central axis of the cam ring 8 is eccentric relative to the rotational axis 0 (on the side in the negative x-axis direction), greater distances in a rotor radial direction between the rotor outer peripheral surface 6*a* and the cam ring inner peripheral surface 80 (a radial dimension of the pump chamber r) result in a direction from the positive x-axis direction side toward the negative x-axis direction side. As the vane 7 protrude from, and retract in, the slits 61 according to these changes in the distance, each of the pump chambers r is defined and the pump chambers r on the negative x-axis direction side have volumes greater than those of the pump chambers r on the positive x-axis direction side. These differences in volumes of the pump chambers r result in increasing volumes of the pump chambers r as the rotor 6 rotates on the lower side of FIG. 2 relative to the rotational axis 0 (the pump chambers r toward the negative x-axis direction side) and decreasing volumes of the pump chambers r as the rotor 6 rotates on the upper side of FIG. 2 relative to the rotational axis 0 (the pump chambers r toward the positive x-axis direction side).

[Details of Pump Body]

(Pressure Plate)

The pressure plate 41 has a suction port 43*a*, a discharge port 44*a*, and back pressure ports 45, 46. Each of these ports is formed in the positive z-axis direction side surface 410 of the pressure plate 41.

The suction port 43*a* serves as an inlet for introducing from outside the hydraulic fluid into the pump chambers r on a suction side. Referring to FIG. 2, the suction port 43*a* is disposed in a section over which the volume of the pump chambers r increases with the rotation of the rotor 6. The suction port 43*a* is a groove formed into a substantially arcuate shape about the rotational axis 0 along the pump chambers r on the suction side. Hydraulic pressure on the pump suction side is introduced through the suction port 43*a*. A suction zone of the vane pump 1 is disposed over a range of an angle corresponding to the suction port 43*a*, specifically, a range of an angle corresponding to substantially 4.5 pitches formed between a start point on the positive x-axis direction side and an end point on the negative x-axis direction side of the suction port 43*a* relative to the rotational axis 0.

The discharge port 44*a* serves as an outlet for discharging the hydraulic fluid from the pump chambers r on a discharge side to the outside. The discharge port 44*a* is disposed in a section over which the volume of the pump chambers r decreases with the rotation of the rotor 6. The discharge port 44*a* is a groove formed into a substantially arcuate shape about the rotational axis 0 along the pump chambers r on the discharge side. Hydraulic pressure on the pump discharge side is introduced through the discharge port 44*a*.

A discharge zone of the vane pump 1 is disposed over a range of an angle corresponding to the discharge port 44*a*, specifically, a range of an angle corresponding to substantially 4.5 pitches formed between a start point on the negative x-axis direction side and an end point on the positive x-axis direction side of the discharge port 44*a* relative to the rotational axis 0. A first containing zone is disposed over a range of an angle formed between the end point of the suction port 43*a* and the start point of the discharge port 44*a*. A second containing zone is disposed over a range of an angle formed between the end point of the discharge port 44*a* and the start point of the suction port 43*a*. The first containing zone and the second containing zone are each a zone over which the hydraulic fluid in the pump chambers r disposed in the zone is contained to thereby prevent the suction port 43*a* and the discharge port 44*a* from being brought into communication with each other. An angular range of each of the first containing zone and the second containing zone corresponds substantially to one pitch.

In the pressure plate 41, the back pressure ports 45, 46 that communicate with roots (back pressure chamber br, slit proximal end portion of the rotor 6) of the vanes 7 are disposed separately from each other on the suction side and the discharge side, respectively. The suction side back pressure port 45 communicates with the back pressure chambers br of the multiple vanes 7 disposed in most of the suction zone and the suction port 43*a*. The suction side back pressure port 45 is a groove to which the hydraulic pressure on the pump suction side is introduced, and is formed into a substantially arcuate shape about the rotational axis 0 along disposition of the back pressure chambers br of the vanes 7 (slit proximal end portions).

The discharge side back pressure port 46 communicates with the back pressure chambers br of the multiple vanes 7 disposed in the discharge zone and substantially half of the first and second containing zones. The discharge side back pressure port 46 is a groove to which the hydraulic pressure on the pump discharge side is introduced, and is formed into a substantially arcuate shape about the rotational axis 0 along disposition of the back pressure chambers br of the vanes 7 (slit proximal end portions).

The suction side back pressure port 45 and the discharge side back pressure port 46 are disposed at rotor radial positions at which a good part of the suction side back pressure port 45 and the discharge side back pressure port 46 overlaps the back pressure chambers br as viewed from the z-axis direction, regardless of where the cam ring 8 is eccentrically located. The suction side back pressure port 45 and the discharge side back pressure port 46 communicate with the back pressure chambers br when overlapping therewith.

It is noted that the vane 7 is "positioned at the suction zone" when a distal end portion of the vane 7 (vane distal end portion 70) overlaps the suction port 43*a* as viewed from the z-axis direction and the vane 7 is "positioned at the discharge zone or the like" when the vane distal end portion 70 overlaps the discharge port 44*a* or the like as viewed from the z-axis direction.

(Rear Body)

The rear body 40 has a bearing retaining hole 40*d*, a low pressure chamber 40*e*, and a high pressure chamber 40*f* formed therein. A bushing 48 as a bearing is disposed in an inner periphery of the bearing retaining hole 40*d*. The drive shaft 5 has a negative z-axis direction end portion rotatably mounted on an inner peripheral side of the bushing 48. The low pressure chamber 40*e* communicates with a reservoir not shown via a reservoir mounting hole 400. The reservoir is a hydraulic fluid source that stores the hydraulic fluid and can supply the vane pump 1 with the hydraulic fluid. Pressure of the hydraulic fluid in the reservoir is substantially the atmospheric pressure.

The high pressure chamber 40*f* formed in the shape of a bag is disposed at a bottom portion on the negative z-axis direction side in the housing recess 40*b*. The high pressure chamber 40*f* communicates with a discharge passage 30 of a hydraulic circuit 3. The discharge passage 30 communicates with a supply passage 34 for supplying supply pressure to the CVT 100 outside the vane pump 1 via a metering orifice (orifice 320).

(Front Body)

The front body 42 has a bearing retaining hole 42*d* and a low pressure chamber 42*e* formed therein. A bushing 49 as a bearing is disposed in an inner periphery of the bearing retaining hole 42*d*. The drive shaft 5 has a positive z-axis direction end portion rotatably mounted on an inner peripheral side of the bushing 49. The low pressure chamber 42*e* communicates with the low pressure chamber 40*e* in the rear body 40 via a communication passage 401 formed in the rear body 40.

The front body 42 has a suction port 43*b*, a discharge port 44*b*, and a cam port 47. Each of these ports is formed in the negative z-axis direction side surface 420 of the front body 42.

The suction port 43*b* serves as an inlet for introducing from outside the hydraulic fluid into the pump chambers r on the suction side. Referring to FIG. 2, the suction port 43*b* is disposed in the section over which the volume of the pump chambers r increases with the rotation of the rotor 6. The suction port 43*b* is a groove formed into a substantially arcuate shape about the rotational axis 0 along the pump chambers r on the suction side. Hydraulic pressure on the pump suction side is introduced through the suction port 43*b*. A suction zone of the vane pump 1 is disposed over a range of an angle corresponding to the suction port 43*b*, specifically, a range of an angle corresponding to substantially 4.5 pitches formed between a start point on the positive x-axis direction side and an end point on the negative x-axis direction side of the suction port 43*b* relative to the rotational axis 0.

The discharge port 44*b* serves as an outlet for discharging the hydraulic fluid from the pump chambers r on a discharge side to the outside. The discharge port 44*b* is disposed in a section over which the volume of the pump chambers r decreases with the rotation of the rotor 6. The discharge port 44*b* is a groove formed into a substantially arcuate shape about the rotational axis 0 along the pump chambers r on the discharge side. Hydraulic pressure on the pump discharge side is introduced through the discharge port 44*b*.

A discharge zone of the vane pump 1 is disposed over a range of an angle corresponding to the discharge port 44*b*, specifically, a range of an angle corresponding to substantially 4.5 pitches formed between a start point on the negative x-axis direction side and an end point on the positive x-axis direction side of the discharge port 44*b* relative to the rotational axis 0. A first containing zone is disposed over a range of an angle formed between the end point of the suction port 43*b* and the start point of the discharge port 44*b*. A second containing zone is disposed over a range of an angle formed between the end point of the discharge port 44*b* and the start point of the suction port 43*b*. The first containing zone and the second containing zone are each a zone over which the hydraulic fluid in the pump chambers r disposed in the zone is contained to thereby prevent the suction port 43*b* and the discharge port 44*b* from being brought into communication with each other. An angular range of each of the first containing zone and the second containing zone corresponds substantially to one pitch.

The cam port 47 is disposed circularly about the rotational axis 0 extending over an entire periphery along an inner periphery of the circular recess 62 in the rotor 6. The hydraulic pressure on the pump suction side is introduced to the cam port 47.

[Details of Vane]

Figure 4:
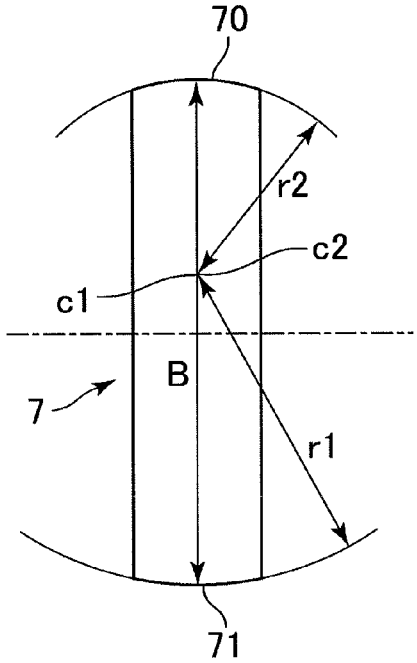
FIG. 4 is an illustration showing a vane according to the first embodiment of the present invention, as viewed from a rotating axial direction of a rotor.

FIG. 4 is an illustration showing the vane 7, as viewed from a rotating axial direction of the rotor 6. The vane 7 has an end adjacent to the cam ring 8 (vane distal end portion 70) and an end adjacent to the rotor 6 (vane proximal end portion 71). Each of the vane distal end portion 70 and the vane proximal end portion 71 is formed into an outwardly protruding curved surface as viewed from the rotating axial direction of the rotor 6 (in a plane perpendicular to the rotational axis). A center c2 of a curved surface of the vane distal end portion 70 and a center c1 of a curved surface of the vane proximal end portion 71 are disposed on an axis of the vane 7 and offset on the side of the vane distal end portion 70 relative to the center of an axial length of the vane 7. Let r2 be a radius of the curved surface of the vane distal end portion 70 and r1 be a radius of the curved surface of the vane proximal end portion 71. Then, the curved surfaces are formed such that the sum of the radius r2 and the radius r1 coincides with an axial length B of the vane 7. Specifically, the curved surfaces are formed such that the center c2 of the curved surface of the vane distal end portion 70 and the center c1 of the curved surface of the vane proximal end portion 71 coincide with each other. Furthermore, the radius r2 of the curved surface of the vane distal end portion 70 is formed to be smaller than the radius r1 of the curved surface of the vane proximal end portion 71.

It is noted that, in reality, the sum of the radius r2 and the radius r1 does not necessarily coincide exactly with the axial length B of the vane 7, and the center c2 and the center c1 are not necessarily disposed on the axis of the vane 7, either. Specifically, the center c2 of the curved surface of the vane distal end portion 70 and the center c1 of the curved surface of the vane proximal end portion 71 may be disposed close to each other and on the side of the vane distal end portion 70 relative to the center of the axial length of the vane 7.

Arrangements of Control Unit

The control unit of the vane pump 1 includes control chambers R1, R2, the control valve 2, and the hydraulic circuit 3. A space between the housing hole 90 in the adapter ring 9 and the cam ring outer peripheral surface 81 has a negative z-axis direction side and a positive z-axis direction side sealed by the pressure plate 41 and the front body 42, respectively. Further, the space is partitioned into the two control chambers R1, R2 fluid-tightly by an abutment portion between the rolling surface 91 and the cam ring outer peripheral surface 81 and an abutment portion between the sealing member S1 and the cam ring outer peripheral surface 81. In the outer peripheral side of the cam ring 8, a first control chamber R1 is defined on the side of the negative x-axis direction in which the amount of eccentricity δ of the cam ring 8 increases and a second control chamber R2 is defined on the side of the positive x-axis direction in which the amount of eccentricity δ of the cam ring 8 decreases.

The hydraulic circuit 3 includes passages for the hydraulic fluid connecting between different parts in the pump body 4. The passages are mainly disposed in the rear body 40. The rear body 40 also includes a substantially cylindrical valve housing hole 40*a* extending in the x-axis direction. The control valve 2 has the spool 20 housed in the valve housing hole 40*a*. The discharge passage 30 that communicates with a discharge port 44 of the pump unit branches into a first control source pressure passage 31 and a discharge passage 32.

The first control source pressure passage 31 communicates with the negative x-axis direction side of the valve housing hole 40*a*. Pressure that is substantially equal to the hydraulic pressure to be discharged from the discharge port 44 (discharge pressure) is supplied to the control valve 2 through the first control source pressure passage 31 as a source pressure of the hydraulic pressure (control pressure) for controlling the amount of eccentricity δ of the cam ring 8. The orifice 320 as a throttling part having a flow passage cross sectional area smaller than those of other parts of the passage is disposed in the discharge passage 32. The discharge passage 32 branches into a second control source pressure passage 33 and the supply passage 34 at a point downstream of the orifice 320.

Hydraulic pressure that is the discharge pressure from the discharge port 44 slightly reduced by the orifice 320 (supply pressure) is supplied through the supply passage 34 to the CVT 100.

The second control source pressure passage 33 communicates with the positive x-axis direction side of the valve housing hole 40*a*. Pressure that is substantially equal to the supply pressure is supplied to the control valve 2 through the second control source pressure passage 33 as a source pressure of the control pressure.

A first control passage 35 communicates with the valve housing hole 40*a* at a position adjacent, on the positive x-axis direction side, to an opening in the valve housing hole 40*a* communicating with the first control source pressure passage 31. The first control passage 35 communicates with the first control chamber R1 of the pump unit via a through hole 92 that penetrates radially through the adapter ring 9. In addition, a second control passage 36 communicates with the valve housing hole 40*a* at a position adjacent, on the negative x-axis direction side, to an opening in the valve housing hole 40*a* communicating with the second control source pressure passage 33. The second control passage 36 communicates with the second control chamber R2 of the pump unit via a through hole 93 that penetrates radially through the adapter ring 9.

The control valve 2 is a hydraulic pressure control valve (spool valve) that operates (displaces) the valve element (spool 20) to thereby change a destination of the supply of the hydraulic fluid between the first control chamber R1 and the second control chamber R2. The control valve 2 includes the spool 20 and a coil spring 21. Specifically, the spool 20 is housed in the valve housing hole 40*a* so as to be capable of being displaced (making a stroke motion) in the x-axis direction. The coil spring 21 is disposed in a compressed state in the valve housing hole 40*a* on the positive x-axis direction side of the spool 20. The coil spring 21 functions as a return spring to urge the spool 20 in the negative x-axis direction at all times. The coil spring 21 is retained at its positive x-axis direction end by a retainer 22 that is threadedly attached to a threaded part 40*c* on the positive x-axis direction side of the valve housing hole 40*a*.

The control valve 2 is a solenoid valve integrating the solenoid SOL. Operation of the control valve 2 (displacement of the spool 20) is controlled by a difference in hydraulic pressure (first and second hydraulic pressures) acting on both sides of the spool 20 according to a discharge flow rate of the pump unit and a thrust force acting on the spool 20 from the solenoid SOL based on a command from the CVT control unit 130.

The spool 20 includes a first large-diameter portion 201 and a second large-diameter portion 202 for port blockage (or for varying port opening). The first large-diameter portion 201 is disposed on the negative x-axis direction side of the spool 20 and the second large-diameter portion 202 is disposed at an end portion on the positive x-axis direction side of the spool 20. Each of the first and second large-diameter portions 201, 202 has a substantially cylindrical shape and an outside diameter dimension that is substantially identical to an inside diameter dimension of the substantially cylindrical valve housing hole 40*a*.

A first pressure chamber 23, a second pressure chamber 24, and a drain chamber 25 are defined inside the valve housing hole 40*a*. Specifically, the first pressure chamber 23 is defined by the first large-diameter portion 201 and a negative x-axis direction end portion of the solenoid SOL. The second pressure chamber 24 is defined by the second large-diameter portion 202 and a positive x-axis direction end portion of the valve housing hole 40*a*. The drain chamber 25 is defined by the first large-diameter portion 201 and the second large-diameter portion 202. Regardless of the displacement of the spool 20, the first control source pressure passage 31 communicates with the first pressure chamber 23 at all times and the second control source pressure passage 33 communicates with the second pressure chamber 24 at all times. The drain chamber 25 communicates with a drain passage not shown and is maintained at lower pressure (open to the atmosphere).

As the spool 20 is displaced in the x-axis direction, an area (an opening area of the passage) of the opening in the valve housing hole 40*a* communicating with each of the first control passage 35 or the second control passage 36 (supply or discharge hole, specifically, port of the hydraulic fluid) blocked by each of the first and second large-diameter portions 201, 202 is varied. This results in each of the passages maintaining communication or being shut down.

Each of the openings is disposed as follows. In a condition in which the spool 20 is displaced most on the negative x-axis direction side, the first large-diameter portion 201 interrupts communication of the opening in the first control passage 35 with the first pressure chamber 23, while allowing communication of the opening in the first control passage 35 with the drain chamber 25. Under the same condition, the second large-diameter portion 202 interrupts communication of the opening in the second control passage 36 with the drain chamber 25, while allowing communication of the opening in the second control passage 36 with the second pressure chamber 24.

As the spool 20 is displaced on the positive x-axis direction side, the area of the opening in the first control passage 35 closed by the first large-diameter portion 201 increases, so that communication between the first control passage 35 and the drain chamber 25 is interrupted. When the spool 20 is displaced a predetermined amount or more on the positive x-axis direction side, the first control passage 35 and the first pressure chamber 23 are brought into communication with each other.

Additionally, as the spool 20 is displaced on the positive x-axis direction side, the area of the opening in the second control passage 36 closed by the second large-diameter portion 202 increases, so that communication between the second control passage 36 and the second pressure chamber 24 is interrupted. When the spool 20 is displaced a predetermined amount or more on the positive x-axis direction side, the second control passage 36 and the drain chamber 25 are brought into communication with each other.

The solenoid SOL is energized based on a command from the CVT control unit 130, pressing a plunger 2*a* toward the positive x-axis direction side with a thrust force variable according to the amount of energizing current. A positive x-axis direction end portion of the plunger 2*a* abuts on a negative x-axis direction end portion of the spool 20 and the spool 20 is thereby urged toward the positive x-axis direction side with an electromagnetic force of the solenoid SOL. This produces an effect identical to that when an initial set load of the coil spring 21 is changed a little. At this time, the spool 20 is displaced with a differential pressure smaller (at earlier timing) than when the solenoid SOL remains de-energized, to thereby achieve a relatively low discharge flow rate before a predetermined flow rate is maintained. Specifically, the discharge flow rate can be controlled with an urging force generated by the solenoid SOL. The CVT control unit 130 controls the solenoid SOL through, for example, PWM control to thereby vary a pulse width of a drive voltage. Desired rms current is thereby passed through a coil of the solenoid SOL and the drive force of the plunger 2*a* is thereby continuously varied. The CVT control unit 130 controls line pressure appropriately according to an accelerator operation amount, an engine speed, a vehicle speed, and related driving conditions. When a high discharge flow rate is requested, therefore, current (electromagnetic force) to be passed through the solenoid SOL is turned OFF or reduced. When a low discharge flow rate is requested, the current (electromagnetic force) to be passed through the solenoid SOL is increased.

[Operation]

Operation of the vane pump 1 according to the first embodiment of the present invention will be described below.

(Pump Operation)

Rotating the rotor 6 under a condition in which the cam ring 8 is eccentric in the negative x-axis direction relative to the rotational axis 0 causes the pump chambers r to expand and contract periodically, while rotating about the rotational axis 0. In the suction zone in which the pump chambers r expand in the rotating direction, hydraulic fluid is drawn into the pump chambers r through a suction port 43. In the discharge zone in which the pump chambers r contract in the rotating direction, the drawn hydraulic fluid is discharged to the discharge port 44 from the pump chambers r.

Specifically, focusing only on a specific pump chamber r, the volume of the specific pump chamber r increases until a vane 7 on the negative rotating direction side of the pump chamber r (hereinafter referred to as the "rear side vane 7") moves past the end point of the suction port 43, or to state the foregoing differently, until a vane 7 on the rotating direction side (hereinafter referred to as the "front side vane 7") moves past the start point of the discharge port 44. During this period, the specific pump chamber r communicates with the suction port 43, so that the hydraulic fluid is drawn in through the suction port 43.

At a rotating position, in the first containing zone, at which the (face on the rotating direction side of the) rear side vane 7 of the specific pump chamber r coincides with the end point of the suction port 43 and the (face on the negative rotating direction side of the) front side vane 7 of the specific pump chamber r coincides with the start point of the discharge port 44, the specific pump chamber r communicates with neither the suction port 43 nor the discharge port 44 and is maintained fluid-tightly.

After the rear side vane 7 of the specific pump chamber r has moved past the end point of the suction port 43 (the front side vane 7 has moved past the discharge port 44), the volume of the specific pump chamber r decreases with rotation in the discharge zone, so that the specific pump chamber r communicates with the discharge port 44. The hydraulic fluid is thus discharged to the discharge port 44 from the pump chamber r.

At a rotating position, in the second containing zone, at which the rear side vane 7 of the specific pump chamber r coincides with the end point of the discharge port 44 and the front side vane 7 of the specific pump chamber r coincides with the start point of the suction port 43, the specific pump chamber r communicates with neither the discharge port 44 nor the suction port 43 and is maintained fluid-tightly.

In the first embodiment of the present invention, the range of each of the first containing zone and the second containing zone corresponds only to one pitch (for one pump chamber r). The suction zone and the discharge zone can therefore be expanded as much as possible while preventing the two zones from communicating with each other, so that pump efficiency can be improved. The containing zone (the spacing between the suction port 43 and the discharge port 44) may still be provided to extend over a range of one pitch or more.

(Variable Displacement Operation)

When the cam ring 8 oscillates on the negative x-axis direction side to have non-zero amount of eccentricity 6 relative to the rotor 6, the volume of the pump chamber r increases with the rotation of the rotor 6 in the suction zone and becomes a maximum when the pump chamber r is positioned in the first containing zone. In the discharge zone, the volume of the pump chamber r decreases with the rotation of the rotor 6 and becomes a minimum when the pump chamber r is positioned in the second containing zone. At a maximum eccentric position shown in FIG. 2, the difference in volume between contraction and expansion of the pump chamber r becomes a maximum and pump displacement also becomes a maximum.

At a minimum eccentric position at which the cam ring 8 oscillates on the positive x-axis direction side to have a minimum (zero) amount of eccentricity 6, the volume of the pump chamber r does not increase or decrease with the rotation of the rotor 6. To state the foregoing differently, the difference in volume among the pump chambers r becomes a minimum (zero) and the pump displacement also becomes a minimum. As such, the difference in volume varies with the amount of oscillation of the cam ring 8, and the pump displacement varies accordingly.

The vane pump 1 includes the control valve 2 as means for controlling variably pump displacement. The control valve 2 receives a supply of pressure from the discharge port 44 and, using the supplied pressure as a source pressure, produces control pressure for controlling the amount of eccentricity δ. Specifically, hydraulic fluid compressed in the pump chamber r in the discharge zone is supplied via the discharge port 44 to the high pressure chamber 40*f*. The hydraulic fluid in the high pressure chamber 40*f* is supplied through the discharge passage 30 and the first control source pressure passage 31 to the first pressure chamber 23 of the control valve 2 and through the discharge passage 30, the discharge passage 32, and the second control source pressure passage 33 to the second pressure chamber 24 of the control valve 2.

The first control chamber R1, receiving the supply of the hydraulic fluid (control pressure) from the first pressure chamber 23 of the control valve 2 via the first control passage 35, generates a first hydraulic force that resists the urging force of the coil spring SPG to thereby press the cam ring 8 toward the positive x-axis direction side. The second control chamber R2, receiving the supply of the hydraulic fluid (control pressure) from the second pressure chamber 24 of the control valve 2 via the second control passage 36, generates a second hydraulic force that assists the urging force of the coil spring SPG to thereby press the cam ring 8 toward the negative x-axis direction side.

If the sum of the first hydraulic force and the second hydraulic force acts to press the cam ring 8 toward the positive x-axis direction side and is greater than the urging force of the coil spring SPG to press the cam ring 8 toward the negative x-axis direction side, then the cam ring 8 moves toward the positive x-axis direction side. Then, the amount of eccentricity δ becomes small and the difference in volume between contraction and expansion of the pump chamber r becomes small, so that the pump displacement decreases. In contrast, if the sum of the first hydraulic force and the second hydraulic force acts to press the cam ring 8 toward the positive x-axis direction side and is smaller than the urging force of the coil spring SPG, or if the sum of the hydraulic forces acts to press the cam ring 8 toward the negative x-axis direction side, then the cam ring 8 moves toward the negative x-axis direction side. Then, the amount of eccentricity δ becomes large and the difference in volume between contraction and expansion of the pump chamber r becomes large, so that the pump displacement increases.

In a condition in which no hydraulic fluid is supplied to the first control chamber R1 and the second control chamber R2, the cam ring 8 is urged toward the negative x-axis direction side by the coil spring SPG and the amount of eccentricity δ becomes a maximum.

It is noted that the amount of eccentricity δ may be controlled with only the hydraulic force of the first control chamber R1 without having the second control chamber R2. A member other than the coil spring may also be used as the elastic member for urging the cam ring 8.

The control valve 2 changes over the supply of control pressure through displacement of the spool 20. Specifically, when the spool 20 is displaced on the positive x-axis direction side, the hydraulic fluid (control pressure) is supplied from the first pressure chamber 23 to the first control chamber R1 via the first control passage 35. In contrast, when the spool 20 is displaced on the negative x-axis direction side, the hydraulic fluid (control pressure) is supplied from the second pressure chamber 24 to the second control chamber R2 via the second control passage 36. The spool 20 is displaced as pressure (the first and second hydraulic forces) supplied from the discharge port 44 acts thereon. Consequently, the control valve 2 operates automatically according to the operation of the pump unit that is an object to be controlled, which eliminates the need for providing separate control means for controlling the operation of the control valve 2, thus simplifying the arrangement.

Specifically, the control valve 2 is arranged as follows: if the first hydraulic force and the second hydraulic force act on the spool 20 when the speed of the rotor 6 is greater than zero and equal to, or less than, a predetermined value α, the spool 20 is displaced on the negative x-axis direction side so that control pressure to increase the amount of eccentricity δ is supplied; and if the first hydraulic force and the second hydraulic force act on the spool 20 when the speed of the rotor 6 is greater than the predetermined value α, the spool 20 is displaced on the positive x-axis direction side so that control pressure to increase the amount of eccentricity δ is supplied. This enables control to be automatically performed so that the pump displacement increases when the vane pump 1 rotates at low speed and the pump displacement decreases when the vane pump 1 rotates at high speed.

More specifically, the position of the spool 20 is controlled as follows: when the rotational speed of the rotor 6 is greater than zero and equal to, or less than, the predetermined value α, the opening in the first control passage 35 is closed by the first large-diameter portion 201 and communication between the first control passage 35 and the first pressure chamber 23 is thereby interrupted; when the rotational speed of the rotor 6 is greater than the predetermined value α, the opening in the first control passage 35 is not closed by the first large-diameter portion 201 and the first control passage 35 communicates with the first pressure chamber 23. Control can therefore be performed such that the pump displacement is increased when the vane pump 1 rotates at low speed.

In addition, the second control passage 36 through which control pressure to increase the amount of eccentricity δ is supplied communicates with the valve housing hole 40*a*. The position of the spool 20 is controlled as follows: when the speed of the rotor 6 is greater than zero and equal to, or less than, the predetermined value α, the opening in the second control passage 36 is not closed by the second large-diameter portion 202 and the second control passage 36 communicates with the second pressure chamber 24; when the speed of the rotor 6 is greater than the predetermined value α, the opening in the second control passage 36 is closed by the second large-diameter portion 202 and communication between the second control passage 36 and the second pressure chamber 24 is thereby interrupted. Control can therefore be performed such that the pump displacement is decreased when the vane pump 1 rotates at high speed.

The orifice 320 that generates a large differential pressure according as the passing flow rate increases is disposed in the discharge passage 32 through which pressure (source pressure of the control pressure) is supplied from the discharge port 44 to the second pressure chamber 24. Hydraulic pressure lower than the discharge pressure is thus supplied to the second pressure chamber 24. Meanwhile, no orifice is disposed in the first control source pressure passage 31 through which pressure (source pressure of the control pressure) is supplied from the discharge port 44 to the first pressure chamber 23. Thus, hydraulic pressure substantially equal to the discharge pressure is supplied to the first pressure chamber 23.

Specifically, there is a difference in pressure between the hydraulic fluid supplied to the first control chamber R1 and that supplied to the second control chamber R2 and the magnitude of the differential pressure determines the amount of oscillation of the cam ring 8. As a result, automatic control of decreasing the pump displacement can be achieved even more easily. In the first embodiment of the present invention, the orifice 320 is incorporated as means for generating the differential pressure, which simplifies the arrangement. It is noted that the second pressure chamber 24 may be omitted and the amount of eccentricity 6 of the cam ring 8 may be controlled only with the first pressure chamber 23. In this case, the spool 20 can be displaced by the urging force of the coil spring 21 and the pressure of the first pressure chamber 23.

The CVT control unit 130 uses the solenoid SOL to control operation of the control valve 2 to thereby displace the spool 20, changing over the supply of hydraulic fluid to the first control chamber R1 and the second control chamber R2 and thereby appropriately varying the first hydraulic force and the second hydraulic force. Therefore, unlike the case in which the pump displacement is automatically controlled according to the speed of the vane pump 1 as described above, the pump displacement can be controlled in any way according to, for example, the operating condition of the CVT 100, independently of the speed of the vane pump 1 (engine speed). The control valve 2 is not necessarily a solenoid valve to be controlled by the solenoid SOL and the solenoid SOL may be omitted. The vane pump 1, being capable of controlling the pump displacement variably as described above, can reduce torque (drive torque) required for pump drive to thereby hold a pump output to a necessary minimum. This reduces loss torque (power loss) as compared with a fixed displacement pump.

(Reduction in Power Loss by Isolation of Back Pressure Port)

A centrifugal force acts on the vane 7 (a force to move the vane 7 in the outside diameter direction) during rotation of the rotor 6. Thus, given predetermined conditions including a sufficiently high speed, the vane distal end portion 70 protrudes from the slit 61 to thereby make a sliding contact with the cam ring inner peripheral surface 80 of the cam ring 8. The abutment of the vane distal end portion 70 on the cam ring inner peripheral surface 80 restricts radial movement of the vane 7.

Protrusion of the vane 7 from the slit 61 increases the volume of the back pressure chamber br of the vane 7 and retraction (storage) of the vane 7 in the slit 61 decreases the volume of the back pressure chamber br of the vane 7. Rotating the rotor 6 under a condition in which the cam ring 8 is eccentric in the negative x-axis direction relative to the rotational axis 0 causes the back pressure chamber br of each vane 7 in sliding contact with the cam ring inner peripheral surface 80 to expand and contract periodically, while rotating about the rotational axis 0.

In the suction zone where the back pressure chamber br expands, absence of the supply of the hydraulic fluid to the back pressure chamber br inhibits protrusion of the vane 7, so that the vane distal end portion 70 may not abut on the cam ring inner peripheral surface 80, resulting in fluid tightness not being achieved in the pump chamber r. In the discharge zone where the back pressure chamber br contracts, on the other hand, if the hydraulic fluid is not smoothly discharged from the back pressure chamber br, the vane 7 is inhibited from retracting in the slit 61, which increases sliding resistance between the vane distal end portion 70 and the cam ring inner peripheral surface 80.

In the vane pump 1 according to the first embodiment of the present invention, therefore, the hydraulic fluid is supplied to the back pressure chambers br positioned in the suction zone from the back pressure port 45 on the suction side. Therefore, protruding performance of the vane 7 is improved. Meanwhile, the back pressure chambers br positioned in the discharge zone discharge the hydraulic fluid to the back pressure port 46 on the discharge side. Therefore, sliding resistance of the vane 7 is reduced.

Specifically, in the suction zone, pressure in the suction port 43 acts on the vane distal end portion 70 and pressure in the back pressure port 45 on the suction side acts on the vane proximal end portion 71. Since both the back pressure port 45 on the suction side and the suction port 43 communicate with the low pressure chambers 40*e*, 42*e* as common hydraulic fluid sources, the pressure in the suction port 43 and the pressure in the back pressure port 45 on the suction side are low. The difference between the pressure acting on the vane distal end portion 70 and the pressure acting on the vane proximal end portion 71 is not therefore large. More specifically, the hydraulic fluid is supplied from the reservoir via the low pressure chambers 40*e*, 42*e*, through communication passages 412, 422 to the suction port 43 and, through a communication passage 413 to the back pressure port 45 on the suction side, respectively. The hydraulic fluid is continued to be drawn in the suction zone while the vane pump 1 is being driven, so that the pressure in the suction port 43 (suction pressure) is negative, specifically, equal to, or less than, the atmospheric pressure. Meanwhile, since the back pressure port 45 on the suction side communicates with the suction port 43 via the low pressure chambers 40*e*, 42*e*, the hydraulic fluid with a pressure close to the suction pressure is supplied from the communication passage 413 to the back pressure port 45 on the suction side.

In the discharge zone, pressure in the discharge port 44 acts on the vane distal end portion 70 and pressure in the back pressure port 46 on the discharge side acts on the vane proximal end portion 71. Since both the back pressure port 46 on the discharge side and the discharge port 44 communicate with the high pressure chamber 40*f* via communication passages 414, 415, the pressure in the discharge port 44 and the pressure in the back pressure port 46 on the discharge side are both high. The difference between the pressure acting on the vane distal end portion 70 and the pressure acting on the vane proximal end portion 71 is not therefore large. Specifically, when the vane pump 1 is driven, pump action causes the pressure of the hydraulic fluid to increase in the discharge zone, so that the pressure in the discharge port 44 is a discharge pressure higher than the atmospheric pressure. Meanwhile, the back pressure port 46 on the discharge side communicates with the discharge port 44 through the high pressure chamber 40*f*, so that the pressure in the back pressure port 46 on the discharge side is a high pressure close to the discharge pressure.

As a result, the vane distal end portion 70 is prevented from being pressed unnecessarily hard against the cam ring inner peripheral surface 80, so that loss torque as a result of friction occurring when the vane 7 slidably contacts the cam ring inner peripheral surface 80 can be held low.

As described above, in the vane pump 1, the back pressure ports that communicate with the back pressure chambers br of the vanes 7 are disposed separately from each other on the suction side and the discharge side. A difference in pressure can thereby be prevented from occurring between the vane distal end portion 70 and the vane proximal end portion 71 (such as that of a large one between the discharge pressure and the suction pressure) both in a suction stroke and a discharge stroke. The vane 7 can thus be adequately pressed against the cam ring 8 by the centrifugal force, while the sliding resistance can be reduced. Friction can therefore be reduced. Meanwhile, extra drive torque for rotating the rotor 6 is not wasted, so that power loss can be reduced. To state the foregoing differently, the vane pump 1 is what is called a low torque pump requiring low drive torque relative to the rotational speed and offering high efficiency (specifically, capable of reducing power loss and improving fuel consumption). The vane pump 1 has a characteristic of delivering a large displacement for its size compared with the ordinary fixed displacement vane pump (specifically, the vane pump can be built compact).

(Control of Noise Caused by Vane Cam)

Even with the above-described arrangement in which the hydraulic fluid is supplied in the suction zone from the back pressure port 45 on the suction side to the back pressure chamber br, the centrifugal force acting on the vane 7 is small in the low speed range of the pump, such as during starting and idling of the internal combustion engine. During low speed rotation of the pump, therefore, the vane 7 protrudes only insufficiently in the suction stroke, which may cause the vane distal end portion 70 to be spaced apart from the cam ring inner peripheral surface 80. If (the back pressure chamber br of) the vane 7 approaches the back pressure port 46 on the discharge side under the foregoing condition, a high pressure surge acts on the vane 7 (vane proximal end portion 71), jerking the vane 7 out to collide furiously with the cam ring 8, which can produce noise.

The first embodiment of the present invention, therefore, includes the vane cam 27 disposed on the side adjacent to the rotor 6 in the positive z-axis direction. The vane cam 27 is formed to have an outside diameter that is equal to the diameter of the cam ring inner peripheral surface 80 less a value doubling the length of the vane 7. Specifically, the vane cam 27 is eccentric together with the cam ring 8 and has the vane cam outer peripheral surface 27*b* formed to be in contact with all of the vane proximal end portions 71 at all times.

Figure 5:
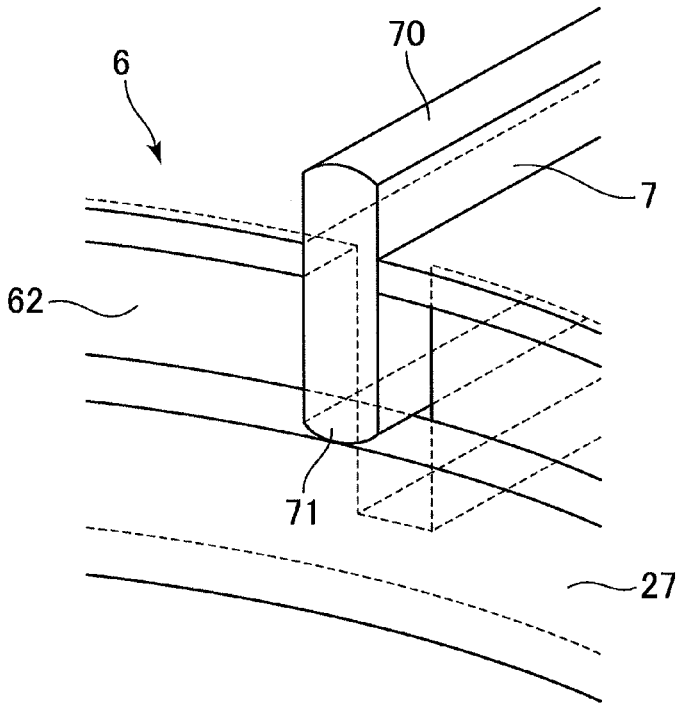
FIG. 5 is a schematic view showing the rotor, the vane, and a vane cam according to the first embodiment of the present invention.

FIG. 5 is a schematic view showing the rotor 6, the vane 7, and the vane cam 27. FIG. 5 is a perspective view showing an area near an end face of the rotor 6 on the positive z-axis direction side. The vane cam 27 is eccentric together with the cam ring 8 and pushes up the vane proximal end portion 71 as shown in FIG. 5. This enables the vane cam 27 to push the vane 7 sufficiently upwardly even in the low speed rotation range of the pump, such as during starting and idling, in which the centrifugal force acting on the vane 7 is small and the vane 7 protrudes only insufficiently with only the centrifugal force, thereby preventing noise from occurring.

(Steady Journaling of Drive Shaft)

The drive shaft 5 is desirably journaled on both ends. In the first embodiment of the present invention, therefore, the vane cam 27 has the through hole 27*a* through which the drive shaft 5 is passed, so that the drive shaft 5 has both ends journaled by the rear body 40 and the front body 42. In addition, the through hole 27*a* has an inside diameter formed so as not to be in contact with the drive shaft 5 when the vane cam 27 is eccentric most.

The drive shaft 5 can thus be journaled on both sides, so that the drive shaft 5 can be steadily journaled.

Achieving Sealing Function of Vane Cam

The hydraulic pressure in the back pressure port 45 on the suction side is supplied to the slits 61 and the back pressure chambers br of the rotor 6 in the suction zone and the hydraulic pressure in the back pressure port 46 on the discharge side is supplied to the slits 61 and the back pressure chambers br of the rotor 6 in the discharge zone. Therefore, the slits 61 and the back pressure chambers br positioned in the suction zone and the discharge zone, respectively, need to be mutually sealed even on a plane in which the vane cam 27 and the rotor 6 contact each other. In the first embodiment of the present invention, therefore, the through hole 27*a* has an inside diameter formed so as to be on the inner peripheral side relative to the proximal end portion of the back pressure chamber br when the vane cam 27 is eccentric most.

The above ensures that the proximal end portion of the back pressure chamber br can be sealed even when the vane cam 27 is eccentric most. In addition, the vane cam 27 has a thickness relative to the depth of the circular recess 62 in the rotor 6, set to such a maximum extent that operation of the vane cam 27 is not hampered. Further, the vane 7 has a length set to such a maximum extent that operation of the vane 7 between the cam ring 8 and the vane cam 27 is not hampered. This enables mutual sealing between the slits 61 and the back pressure chambers br positioned in the suction zone and the discharge zone, respectively.

(Operation of Cam Port)

The vane cam 27, the circular recess 62 in the rotor 6, the vane 7, and the pump body 4 define, on the outer periphery of the vane cam 27, vane cam chambers cr that are equal in number to that of the vanes 7. The vane cam chamber cr has a volume that varies with the rotation of the rotor 6. Specifically, the volume of the vane cam chamber cr decreases with the rotation in the suction zone and increases with the rotation in the discharge zone. It is noted that the total amount of volume decreased of the vane cam chamber cr in the suction zone is equal to that increased of the vane cam chamber cr in the discharge zone.

If the hydraulic fluid does not flow into and out of the vane cam chamber cr as the volume of the vane cam chamber cr changes, the vane cam chamber cr is contained, resulting in the rotor 6 locking up. In the first embodiment of the present invention, therefore, the cam port 47 is formed in the negative z-axis direction side surface 420 of the front body 42 that faces the circular recess 62 in the rotor 6. The hydraulic fluid is thereby allowed to flow into and out of the vane cam chamber cr. Additionally, the cam port 47 extends over the entire periphery and the hydraulic pressure on the pump suction side (suction pressure) is introduced thereinto. Most of the hydraulic fluid discharged as the volume of the vane cam chamber cr decreases on the suction stroke with the rotation of the rotor 6 flows through the cam port 47 into the vane cam chamber cr having an increasing volume on the discharge stroke. Because the suction pressure is introduced to the cam port 47 at this time, the pressure of the cam port 47 is maintained at the suction pressure. This eliminates the likelihood that the hydraulic fluid will be contained in the vane cam chamber cr, which does not prevent the rotor 6 from rotating.

(Prevention of Reduction in Acting Force on Vane Cam and Increase in Drive Torque)

FIGS. 6A to 6D are schematic views showing a method for setting the cam port 47 for introducing hydraulic pressure to the vane cam chamber cr. FIGS. 6A to 6D each show four vanes 7 only. In the first embodiment of the present invention, the cam port 47 extends over the entire periphery of the pump body 4. The hydraulic pressure (suction pressure) on the pump suction side is introduced to the cam port 47. Four main approaches are possible for the introduction of the hydraulic pressure to the cam port 47.

Figure 6:
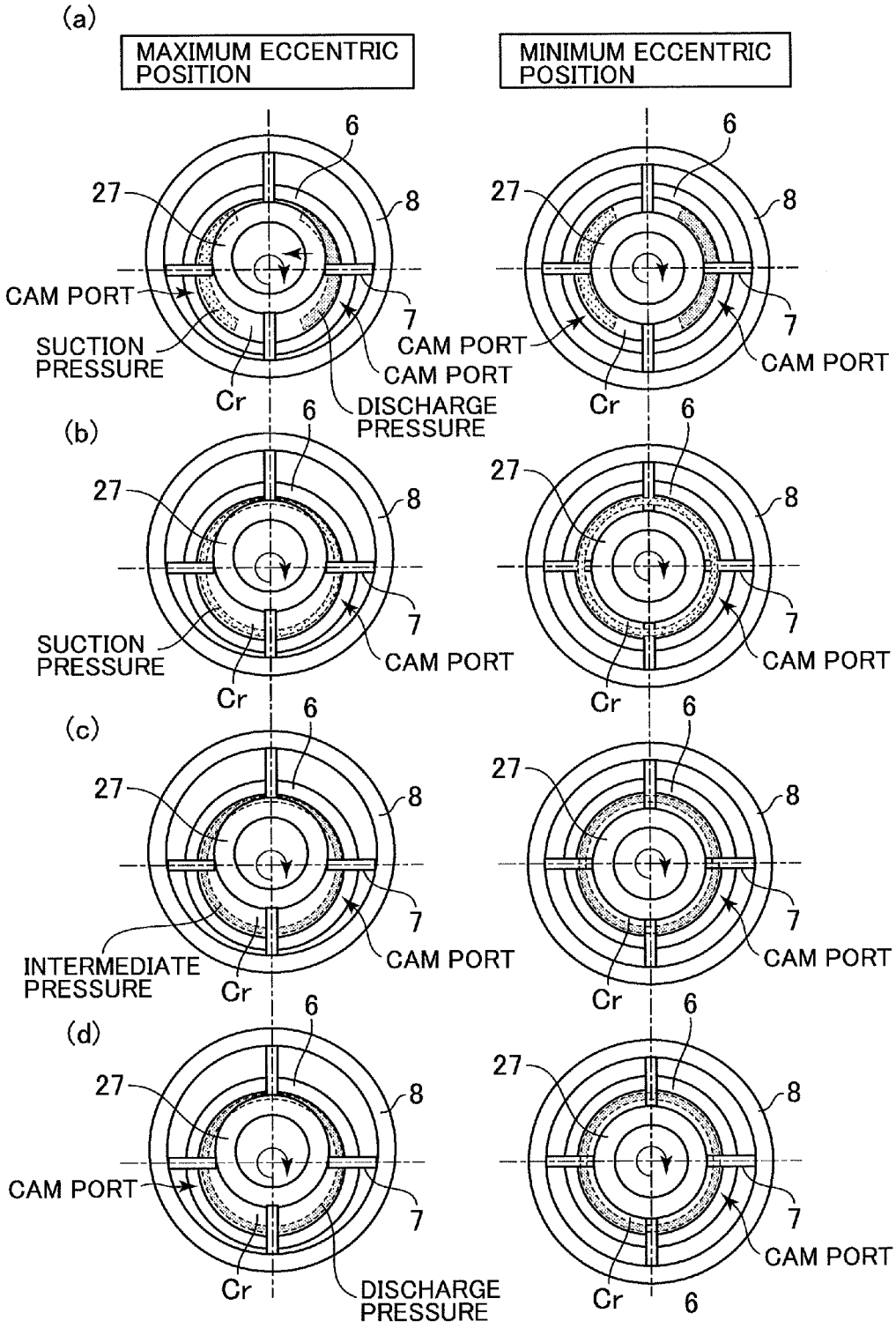
FIGS. 6A to 6D are schematic views showing a method for setting a back pressure port according to the first embodiment of the present invention.

In approach 1, two cam ports 47 are formed, one in the suction zone and one in the discharge zone. The suction pressure is to be introduced to the cam port 47 in the suction zone, while the hydraulic pressure on the pump discharge side (discharge pressure) is to be introduced to the cam port 47 in the discharge zone (FIG. 6A). In approach 2, the cam port 47 is formed to extend over the entire periphery as in the first embodiment of the present invention and the suction pressure is to be introduced to the cam port 47 (FIG. 6B). In approach 3, the cam port 47 is formed to extend over the entire periphery and neither the suction pressure nor the discharge pressure is to be directly introduced to the cam port 47 and an intermediate pressure between the discharge pressure and the suction pressure results as the pressure developing in the cam port (FIG. 6C). In approach 4, the cam port 47 is formed to extend over the entire periphery and the discharge pressure is to be introduced to the cam port 47 (FIG. 6D).

Figures 7, 8:
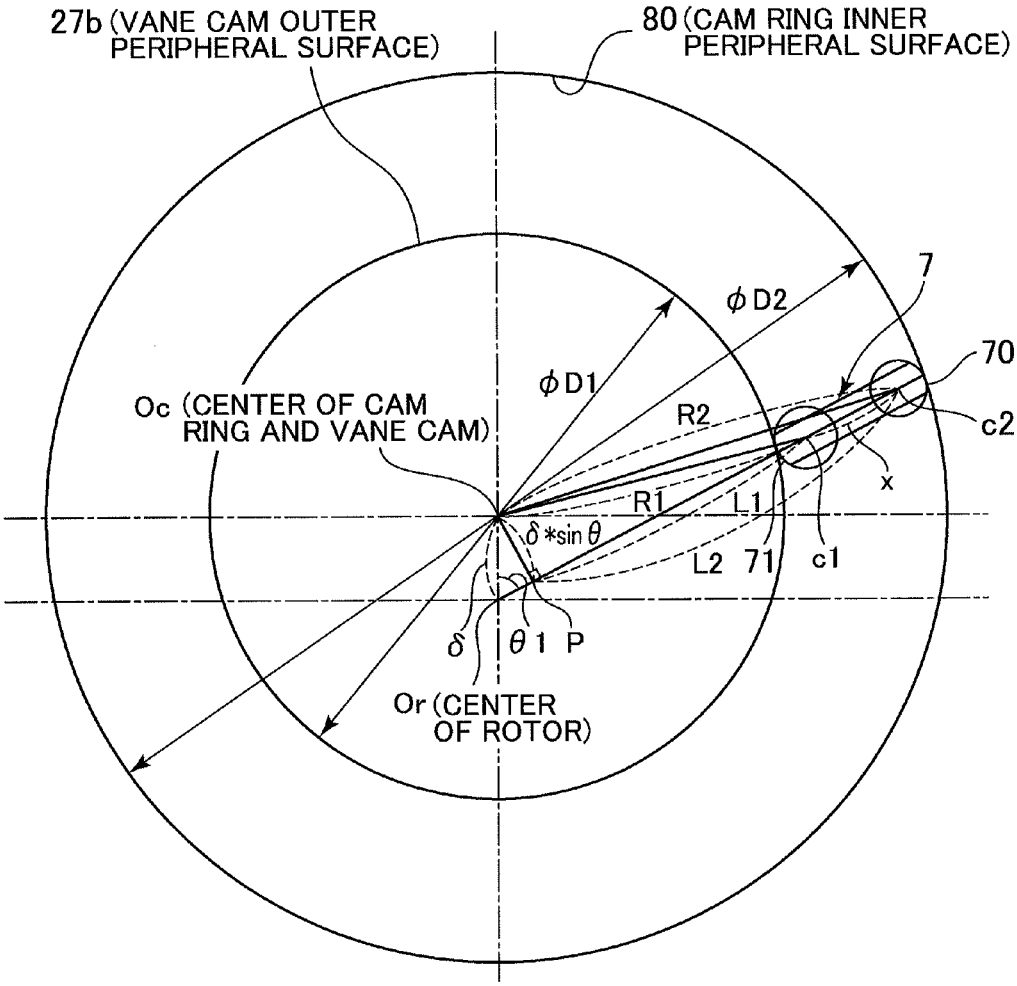
FIG. 7 is a table that summarizes effects on drive torque from pressure around the vane cam, an acting force of the vane cam, and a frictional force of the vane cam.
FIG. 8 is a schematic view showing positional relationships among the rotor, a cam ring, the vane cam, and the vane according to the first embodiment of the present invention.

FIG. 7 is a table that summarizes effects on the drive torque from pressure around the vane cam 27, an acting force of the vane cam 27, and a frictional force of the vane cam 27 in each of the foregoing approaches. Symbols in FIG. 7 denote effects in the order of increasing magnitude: $A^{+} \rightarrow A \rightarrow B \rightarrow C$.

<Approach 1>

Pressure Around Vane Cam

Because the suction pressure acts on the cam port 47 in the suction zone and the discharge pressure acts on the cam port 47 in the discharge zone, the discharge pressure acts on the discharge zone around the vane cam 27 and the suction pressure acts on the suction zone around the vane cam 27.

Vane Cam Acting Force: Radial

The discharge pressure acts on the discharge zone around the vane cam 27 and the suction pressure acts on the suction zone around the vane cam 27 as described above. A force thus acts on the vane cam 27 as a whole from the discharge zone side to the suction zone side (from right to left in FIG. 6A). This acting force is received by vanes 7 positioned on the side toward which the force is directed. The number of vanes 7 that receive the acting force depends partly on the position of rotation of the rotor 6. A good part of the force is nonetheless to be received by one to two vanes 7. The suction pressure and the discharge pressure are to act on a substantially semicircular portion of the entire outer periphery of the vane cam 27 and only the one to two vanes 7 receive a differential pressure between the suction pressure and the discharge pressure. This makes it necessary to increase durability of the surface of the vane 7 in contact with the cam ring inner peripheral surface 80 and strength of the vane cam 27.

Vane Cam Acting Force: Axial

The vane cam 27 seals the slits 61 and the back pressure chambers br in the rotor 6. Accordingly, hydraulic pressure also acts axially on the vane cam 27. Because the suction pressure acts on the cam port 47 in the suction zone and the discharge pressure acts on the cam port 47 in the discharge zone, however, the pressures balance axially, so that substantially no axial force acts on the vane cam 27.

Effect on Drive Torque

Because substantially no axial force acts on the vane cam 27, friction in the vane cam 27 substantially eliminates effect on the drive force. However, a force acting radially on the vane cam 27 causes the vanes 7 to be pressed against the cam ring 8, which increases friction, resulting in slightly increased drive torque.

<Approach 2>

Pressure Around Vane Cam

The suction pressure acts on the cam port 47 throughout the entire periphery, so that the suction pressure acts on the entire periphery around the vane cam 27.

Vane Cam Acting Force: Radial

The suction pressure acts on the entire periphery around the vane cam 27 as described above, so that no force caused by the hydraulic fluid acts on the vane cam 27. However, the discharge pressure acts on the distal end of the vanes 7 in the discharge zone and the suction pressure acts on the proximal end portions of the vanes 7 in contact with the vane cam 27. A force thereby acts on the inner peripheral side of the vanes 7 and this force is received by the outer periphery of the vane cam 27. The distal end portion of the vane 7 has an area that is sufficiently smaller than an area corresponding substantially to a semicircle of the outer periphery of the vane cam 27, so that the force acting on the vanes 7 is sufficiently smaller than that of approach 1.

Vane Cam Acting Force: Axial

The vane cam 27 seals the slits 61 and the back pressure chambers br in the rotor 6. Accordingly, hydraulic pressure also acts axially on the vane cam 27. In the discharge zone, therefore, the vane cam 27 is pressed against the side of the front body 42.

In FIG. 7, the axial vane cam acting force is indicated by (C). The vane cam 27 is pressed against the front body 42 that is a fixed member and there is only a little effect as compared with a case in which the vane cam 27 is pressed against the rotor 7 as a rotating member. Hence, the symbol (C) is to show a difference from approach 4.

Effect on Drive Torque

The vane cam 27 is pressed against the side of the front body 42 in the discharge zone. However, because a force acts in a direction of moving the vane cam 27 away from the rotor 6 as a rotating member, friction between the vane 7 and the cam ring inner peripheral surface 80 can at times increase when the amount of eccentricity in the vane cam 27 changes. Additionally, the vane cam 27 causes the vanes 7 in the suction zone to be pressed against the cam ring inner peripheral surface 80 as described above; nonetheless, the foregoing results only in a slight increase in the drive torque as a whole.

<Approach 3>

Pressure around Vane Cam

Because an intermediate pressure acts on the cam port 47 throughout the entire periphery, the intermediate pressure acts around the vane cam 27 throughout the entire periphery.

Vane Cam Acting Force: Radial

The intermediate pressure acts around the vane cam 27 throughout the entire periphery as described above, so that no force caused by the hydraulic fluid acts on the vane cam 27. In the discharge zone, however, the discharge pressure acts on the distal end of the vane 7 and the intermediate pressure acts on the proximal end portion of the vane 7. This results a force acting on the inner peripheral side of the vane 7 and this force is received by the outer periphery of the vane cam 27. In addition, in the suction zone, the suction pressure acts on the distal end of the vane 7 and the intermediate pressure acts on the proximal end portion of the vane 7, so that a force acts on the outer peripheral side of the vane 7. These two acting forces act on the vanes 7 in the suction zone to thereby press the vanes 7 against the cam ring inner peripheral surface 80, thus generating a frictional force. It is noted that the force acting on the vanes 7 on the suction stroke side is the same as that in approach 2.

Vane Cam Acting Force: Axial

The vane cam 27 seals the slits 61 and the back pressure chambers br in the rotor 6. Accordingly, hydraulic pressure also acts axially on the vane cam 27. This results in the vane cam 27 being pressed against the side of the front body 42 in the discharge zone and against the side of the rotor 6 in the suction zone.

Effect on Drive Torque

The vane cam 27 is pressed against the rotor 6 as a rotating member and the front body 42 as a fixed member at all times to thereby make a relative sliding motion, which increases the drive torque.

<Approach 4>

Pressure Around Vane Cam

The discharge pressure acts on the cam port 47 throughout the entire periphery, so that the discharge pressure acts on the entire periphery around the vane cam 27.

Vane Cam Acting Force: Radial

The discharge pressure acts on the entire periphery around the vane cam 27 as described above, so that no force caused by the hydraulic fluid acts on the vane cam 27. In addition, in the suction zone, the suction pressure acts on the distal end of the vane 7 and the discharge pressure acts on the proximal end portion of the vane 7, so that a force acts on the outer peripheral side of the vane 7 to thereby press the vane 7 against the cam ring inner peripheral surface 80, generating a frictional force. This pressing force is the same as that in approach 2 and approach 3. However, a force acts on the vane 7 in a direction of moving the vane 7 away from the vane cam 27. No force therefore acts on the vane cam 27.

Vane Cam Acting Force: Axial

The vane cam 27 seals the slits 61 and the back pressure chambers br in the rotor 6. Accordingly, hydraulic pressure also acts axially on the vane cam 27. This results in the vane cam 27 being pressed against the side of the rotor 6 in the suction zone.

Effect on Drive Torque

The vane cam 27 is pressed against the rotor 6 as a rotating member at all times and the vane cam 27 rotates while making a radial sliding motion with the rotor 6 at all times, which increases the drive torque.

Examining approaches 1 to 4 described above shows that, in approach 2, a force to act on the vane cam 27 or the vane 7 is relatively small and effect on the drive torque from friction is also small. In the first embodiment of the present invention, therefore, the suction pressure is to be introduced to the cam port 47.

(Reducing Clearance Among Vane, Vane Cam, and Cam Ring)

If the cam ring inner peripheral surface 80 is spaced apart from the vane distal end portion 70 (if there is a clearance between the cam ring inner peripheral surface 80 and the vane distal end portion 70), noise may be produced when the cam ring inner peripheral surface 80 collides with the vane distal end portion 70. Similarly, if the vane cam outer peripheral surface 27*b* is spaced apart from the vane proximal end portion 71 (if there is a clearance between the vane cam outer peripheral surface 27*b* and the vane proximal end portion 71), an amount of hydraulic fluid leaking between the vane cam chambers cr and the back pressure chambers br increases. Preferably, the clearance among the vane, the vane cam, and the cam ring is kept small and, more preferably, the clearance is made to be zero.

The vane 7 is disposed so as to substantially coincide axially with a radial direction of the rotor 6. The cam ring 8 and the vane cam 27 are to be eccentric relative to the rotor 6. Specifically, when the cam ring 8 and the vane cam 27 are eccentric relative to the rotor 6, the vane 7 is not to coincide axially with the radial direction of the cam ring 8 and the vane cam 27. To state the foregoing differently, when the cam ring 8 and the vane cam 27 are eccentric relative to the rotor 6, an angle formed by the axis of the vane 7 relative to the radial direction of the cam ring 8 and the vane cam 27 continuously varies during one revolution of the vane pump 1.

The abovementioned clearance varies with the abovementioned angle and thus varies continuously during one revolution of the vane pump 1. In addition, an amount of change in the clearance is proportional to the amount of eccentricity δ of the cam ring 8 and the vane cam 27 relative to the rotor 6.

Following discuss conditions for making the clearance among the vane 7, the cam ring 8, and the vane cam 27 zero at all times even the angle of the axis of the vane 7 changes relative to the radial direction of the cam ring 8 and the vane cam 27 as described above.

Figure 9:
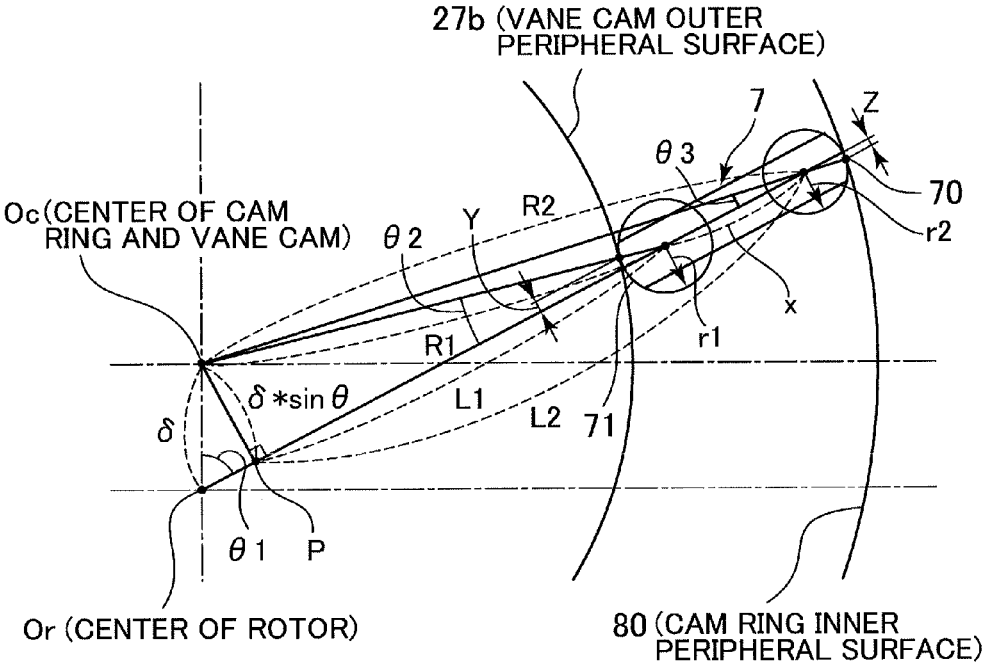
FIG. 9 is an enlarged schematic view showing an area around the vane according to the first embodiment of the present invention.

FIG. 8 is a schematic view showing positional relationships among the rotor 6, the cam ring 8, the vane cam 27, and the vane 7. FIG. 9 is an enlarged schematic view showing an area around the vane 7.

Let D1 be a diameter of the vane cam outer peripheral surface 27*b*, D2 be a diameter of the cam ring inner peripheral surface 80, and δ be a distance (an amount of eccentricity) between a center 0*c* of the cam ring 8 and the vane cam 27 and a center 0*r* of the rotor 6. Further, let B be the axial length of the vane 7, r1 be a radius of curvature of the curved surface of the vane proximal end portion 71, and r2 be a radius of curvature of the curved surface of the vane distal end portion 70. At this time, in a condition in which the vane distal end portion 70 abuts on the cam ring inner peripheral surface 80 and the vane proximal end portion 71 abuts on the vane cam outer peripheral surface 27*b*, a distance R1 between the center 0*c* and the center c1 of the curved surface of the vane proximal end portion 71 and a distance R2 between the center 0*c* and the center c2 of the curved surface of the vane distal end portion 70 may be given by expressions (1) and (2) given below.

$$R1=D1/2+r1 \quad (1)$$

$$R2=D2/2-r2 \quad (2)$$

A straight line is drawn from the center 0*c* to a line segment connecting the center c1 of the curved surface of the vane proximal end portion 71 and the center c2 of the curved surface of the vane distal end portion 70 and an intersection between the straight line and the line segment is defined as a point P. Let θ1 be an angle formed between a line segment connecting the center 0*c* and the center 0*r* and a line segment connecting the center c1 of the curved surface of the vane proximal end portion 71 and the center c2 of the curved surface of the vane distal end portion 70. At this time, a distance L1 between the point P and the center c1 and a distance L2 between the point P and the center c2 are given by expressions (3) and (4) given below.

$$L1=\{R1^2-(\delta\times\sin\theta1)^2\}^{0.5} \quad (3)$$

$$L2=\{R2^2-(\delta\times\sin\theta1)^2\}^{0.5} \quad (4)$$

Let X be a distance between the center c1 and the center c2, then the distance X is given by expression (5) given below.

$$X=L2-L1 \quad (5)$$

From expressions (1) to (5) given above, clearances CL between the vane distal end portion 70 and the cam ring inner peripheral surface 80, and between the vane proximal end portion 71 and the vane cam outer peripheral surface 27*b* are given by expression (6) given below.

$$CL=(X+r1+r2)-B \quad (6)$$

From expression (6), to make the clearance CL zero, conditions of expressions (7) and (8) given below need to be satisfied.

$$X=0 \quad (7)$$

$$r1+r2=B \quad (8)$$

Specifically, the clearance CL can be made zero at all times even with the angle of the axis of the vane 7 varying, if the sum of the radius r2 and the radius r1 coincides with the axial length B of the vane 7, or to state the foregoing differently, if the center of curvature c2 of the curved surface of the vane distal end portion 70 coincides with the center of curvature c1 of the curved surface of the vane proximal end portion 71. In reality, however, it is difficult to make the clearance CL totally zero because of tolerances involved. Still, the clearance CL can be made small by having outwardly protruding curved surfaces on both ends of the vane 7, without having to make the center of curvature c2 of the curved surface of the vane distal end portion 70 coincide with the center of curvature c1 of the curved surface of the vane proximal end portion 71.

(Enhancing Wear Resistance of Vane Both End Portions)

Different optimum values apply to the curvature of the curved surface on either end of the vane depending on, for example, engineering dimensions and operating conditions of the vane pump 1. Focusing on the curvature of the vane distal end portion 70, wear of the sliding surfaces between the vane distal end portion 70 and the cam ring inner peripheral surface 80 is controlled by appropriately lubricating the surfaces with lubricant. Lubricating conditions of the sliding surfaces vary depending on dimensions of the inside diameter of the cam ring, curvature of the vane distal end, and vane thickness, and operating conditions, such as speed, discharge pressure, and viscosity of the hydraulic fluid. For example, an excessively large curvature of the vane distal end portion 70 may cause the vane 7 to be raised off the cam ring inner peripheral surface 80 by a wedge effect of the hydraulic fluid between the vane distal end portion 70 and the cam ring inner peripheral surface 80. At a point near a critical point of the lifting occurring, unusual wear may occur due to chattering of the vane 7. In contrast, an excessively small curvature may cause the contact portions between the vane distal end portion 70 and the cam ring inner peripheral surface 80 to be poorly lubricated. Alternatively, a portion of the vane distal end portion 70 in contact with the cam ring inner peripheral surface 80 moves only a small amount during one revolution of the vane pump 1, which may increase wear in the contact portion.

Next, focusing on the curvature of the vane proximal end portion 71, an excessively large curvature of the vane proximal end portion 71 causes a portion of the vane proximal end portion 71 in contact with the vane cam outer peripheral surface 27*b* to move a large amount during one revolution of the vane pump 1, which may result in contact by an edge of the vane proximal end portion 71. In this case, a small contact area results and the contact portion may wear more. In contrast, an excessively small curvature of the vane proximal end portion 71 results in a small contact area between the vane cam outer peripheral surface 27*b* and the vane proximal end portion 71 at all times, which may cause the contact portion to wear more.

As described earlier, to make the clearance among the cam ring 8, the vane 7, and the vane cam 27 zero at all times, preferably, the centers of curvature c1 and c2 of the curved surfaces on both ends of the vane are made to coincide with each other. An optimum position of the center of curvature may be selected according to the dimensions of different parts of the vane pump and operating conditions. In the first embodiment of the present invention, the center of curvature of both ends of the vane is disposed on the distal end side relative to the central point in length of the vane 7 from experience.

If the curved surfaces on both ends of the vane have different curvature values from each other, considerations need to be taken into account for prevention of erroneous mounting of wrong parts during assembly. If the curvature is the same, no specific orientation of parts during assembly is necessary, which improves assemblability.

[Effects]

Effects of the vane pump 1 according to the first embodiment of the present invention will be recited below.

(1) The vane pump 1 comprises: the rotor 6 rotatably driven by the drive shaft 5, the rotor 6 having the multiple slits 61 formed on the outer periphery of the rotor 6; the multiple vanes 7, each of the vanes 7 being housed in a corresponding one of the slits 61 in a manner of being capable of protruding from, and retracting in, the slit 61 and having both end faces formed into curved surfaces in a plane perpendicular to the rotational axis of the rotor 6, each of the curved surfaces of the both end faces of the vane 7 having curvature having a center disposed on the distal end side relative to the center of the axial length of the vane 7; the cam ring 8 oscillatably disposed so as to surround the rotor 6; the pump body 4 for housing therein the cam ring 8, the rotor 6, and the vanes 7.

The pump body 4 has a surface (the positive z-axis direction side surface 410 of the pressure plate 41) disposed to face the axial side surfaces of the cam ring 8 and the rotor 6. The positive z-axis direction side surface 410 of the pressure plate 41 forms, in addition to the cam ring 8, the rotor 6, and the vanes 7, the multiple pump chambers r thereon.

The positive z-axis direction side surface 410 of the pressure plate 41 has: the suction port 43 communicating with the suction zone in which each of the pump chambers r has a volume that increases with rotation of the rotor 6; the suction side back pressure port 45 introducing pressure common to that of the suction port 43, and communicating with the proximal end portions of the slits 61 that house the vanes 7 positioned in the suction zone; the discharge port 44 communicating with the discharge zone in which each of the pump chambers r has a volume that decreases with rotation of the rotor 6; and the discharge side back pressure port 46 introducing pressure common to that of the discharge port 44 and communicating with the proximal end portions of the slits 61 that house the vanes 7 positioned in the discharge zone.

The vane pump 1 further comprises: the circular recess 62 (recess) formed in the end portion of the rotor 6 axially opposite to the surface in which the suction side back pressure port 45 and the discharge side back pressure port 46 are formed; the vane cam 27 disposed in the circular recess 62 such that the outer peripheral surface thereof contacts the proximal end portions of all vanes 7 to thereby forcedly make the vanes 7 protrude and retract, the vane cam 27 being movable so as to vary the amount of eccentricity relative to the drive shaft 5; and the cam port 47 formed in the surface of the pump body 4 on the side in abutment with the vane cam 27, the cam port 47 communicating with the circular recess 62 in the rotor 6 in which the vane cam 27 is housed. The vane cam 27 partitions the proximal end portions of the slits 61 that house the vanes 7 positioned in the suction zone from the proximal end portions of the slits 61 that house the vanes 7 positioned in the discharge zone.

The clearance CL between the vane distal end portion 70 and the cam ring inner peripheral surface 80, and between the vane proximal end portion 71 and the vane cam outer peripheral surface 27*b* can therefore be made small. Noise occurring when the vane distal end portion 70 and the cam ring inner peripheral surface 80 collide with each other can thereby be controlled and leak of the hydraulic fluid between the vane proximal end portion 71 and the vane cam outer peripheral surface 27*b* can be prevented.

(2) The vane 7 is formed such that each of the curved surfaces of the both end faces of the vane 7 has curvature having a center coinciding with each other.

The clearances CL between the vane distal end portion 70 and the cam ring inner peripheral surface 80, and between the vane proximal end portion 71 and the vane cam outer peripheral surface 27*b* can therefore be minimized.

(3) The center of curvature c2 of the curved surface of the vane distal end portion 70 and the center of curvature c1 of the curved surface of the vane proximal end portion 71 are disposed on the side of the vane distal end portion 70 relative to the center in the axial length of the vane 7.

This allows the curvature of the vane distal end portion 70 to be small, thereby improving wear resistance of the vane distal end portion 70.

Second Embodiment

A vane pump 1 according to a second embodiment of the present invention will be described.

In the vane pump 1 according to the first embodiment of the present invention, the center of curvature c2 of the curved surface of the vane distal end portion 70 and the center of curvature c1 of the curved surface of the vane proximal end portion 71 are disposed on the side of the vane distal end portion 70 relative to the center in the axial length of the vane 7. In the vane pump 1 according to the second embodiment of the present invention, a center of curvature c2 of a curved surface of a vane distal end portion 70 and a center of curvature c1 of a curved surface of a vane proximal end portion 71 are disposed at the center in an axial length of a vane 7.

In the description that follows, except for the vane 7, like or corresponding parts are identified by the same reference numerals as those used in the first embodiment of the present invention and descriptions for those parts will not be duplicated.

Figure 10:
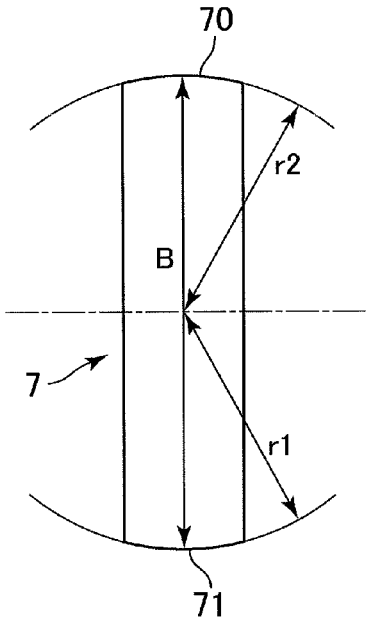
FIG. 10 is an illustration showing a vane according to a second embodiment of the present invention, as viewed from a rotating axial direction of a rotor.

FIG. 10 is an illustration showing the vane 7, as viewed from a rotating axial direction of a rotor 6. Each of the vane distal end portion 70 and the vane proximal end portion 71 is formed into an outwardly protruding curved surface as viewed from the rotating axial direction of the rotor 6 (in a plane perpendicular to the rotating axis). The center of curvature c2 of the curved surface of the vane distal end portion 70 and the center of curvature c1 of the curved surface of the vane proximal end portion 71 are disposed on an axis of the vane 7 and at the center in the axial length of vane 7. Let r2 be a radius of curvature of the curved surface of the vane distal end portion 70 and r1 be a radius of curvature of the curved surface of the vane proximal end portion 71. Then, the vane 7 is formed such that the sum of the radius r2 and the radius r1 coincides with an axial length B of the vane 7. Specifically, the radius r2 equals the radius r1.

In reality, however, the radius r2 and the radius r1 may be substantially equal to each other and the center c2 and the center c1 are not necessarily disposed on the axis of the vane 7. Specifically, the center c2 and the center c1 have only to be disposed near the center of the vane 7.

Effect

Effects of the vane pump 1 according to the second embodiment of the present invention will be recited below.

(4) The center of curvature c2 of the curved surface of the vane distal end portion 70 and the center of curvature c1 of the curved surface of the vane proximal end portion 71 are disposed at the center in the axial of the vane 7.

No specific orientation of the vane during assembly is therefore necessary, which eliminates the need for considerations that should be taken into account for prevention of erroneous mounting of the vane during assembly, so that assemblability can be improved.

Third Embodiment

A vane pump 1 according to a third embodiment of the present invention will be described.

In the vane pump 1 according to the first embodiment of the present invention, the center of curvature c2 of the curved surface of the vane distal end portion 70 and the center of curvature c1 of the curved surface of the vane proximal end portion 71 are disposed on the side of the vane distal end portion 70 relative to the center in the axial length of the vane 7. In the vane pump 1 according to the third embodiment of the present invention, a center of curvature c2 of a curved surface of a vane distal end portion 70 and a center of curvature c1 of a curved surface of a vane proximal end portion 71 are disposed on the side of the vane proximal end portion 71 relative to a center in an axial length of a vane 7.

In the description that follows, except for the vane 7, like or corresponding parts are identified by the same reference numerals as those used in the first embodiment of the present invention and descriptions for those parts will not be duplicated.

Figure 11:
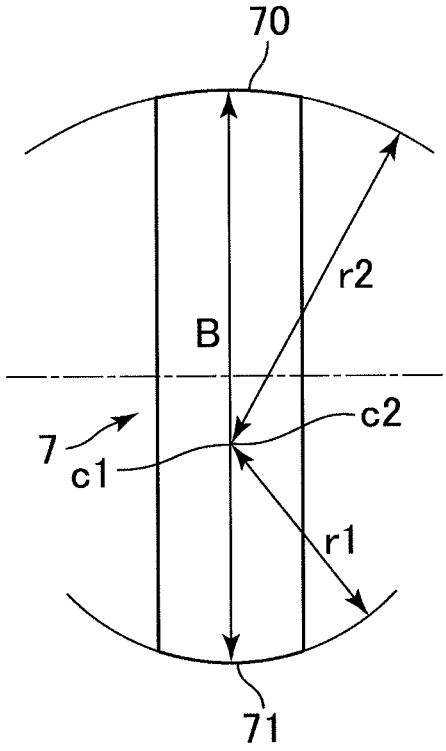
FIG. 11 is an illustration showing a vane according to a third embodiment of the present invention, as viewed from a rotating axial direction of a rotor.

FIG. 11 is an illustration showing the vane 7, as viewed from a rotating axial direction of a rotor 6. Each of the vane distal end portion 70 and the vane proximal end portion 71 is formed into an outwardly protruding curved surface as viewed from the rotating axial direction of the rotor 6 (in a plane perpendicular to the rotating axis). The center of curvature c2 of the curved surface of the vane distal end portion 70 and the center of curvature c1 of the curved surface of the vane proximal end portion 71 are disposed on an axis of the vane 7 and on the side of the vane proximal end portion 71 relative to the center in the axial length of the vane 7. It is noted that the center c2 and the center c1 are not necessarily disposed on the axis of the vane 7.

[Operation]

(Suppressing Movement Amount of Contact Portion)

An excessively large curvature of the curved surface of the vane proximal end portion 71 causes a portion of the vane proximal end portion 71 in contact with a vane cam outer peripheral surface to move a large amount, which may result in contact by an edge of the vane proximal end portion 71. Then, the contact portion may wear more. In the third embodiment of the present invention, therefore, the center of curvature c2 of the curved surface of the vane distal end portion 70 and the center of curvature c1 of the curved surface of the vane proximal end portion 71 are disposed on the side of the vane proximal end portion 71 relative to the center in the axial length of the vane 7. This allows the curvature of the vane proximal end portion 71 to be made small.

Effect

Effects of the vane pump 1 according to the third embodiment of the present invention will be recited below.

(5) The center of curvature c2 of the curved surface of the vane distal end portion 70 and the center of curvature c1 of the curved surface of the vane proximal end portion 71 are disposed on the side of the vane proximal end portion 71 relative to the center in the axial length of the vane 7.

This allows the curvature of the vane proximal end portion 71 to be made small. Movement of the portion of the vane proximal end portion 71 in contact with the vane cam outer peripheral surface can therefore be minimized, so that contact by the edge of the vane proximal end portion 71 can be prevented, which leads to improved durability.

Other Embodiments

While the present invention has been particularly described with reference to various embodiments, it will be understood that the embodiments are not intended to limit the present invention and various changes in form and detail may be made therein without departing from the spirit and scope of the invention.

For example, in the first embodiment of the present invention, the vane cam 27 is disposed on the side of the rotor 6 adjacent to the front body 42. The vane cam 27 may still be disposed on the side of the rotor 6 adjacent to the pressure plate 41. In this case, the back pressure ports 45, 46 need to be disposed on the side of the front body 42 and the cam port 47 needs to be disposed on the side of the pressure plate 41.

In the first embodiment of the present invention, the vane cam 27 has the through hole 27*a*. Instead, the vane cam 27 may be formed into a disc shape to thereby eliminate the through hole 27*a*. In this case, the vane cam 27 needs to be disposed on the side of the rotor 6 adjacent to the pressure plate 41. Because the vane cam 27 does not have the through hole 27*a*, the drive shaft 5 is cantilevered as being journaled only by the front body 42.

What is claimed is:

1. A vane pump comprising:

a rotor rotatably driven by a drive shaft, the rotor having a plurality of slits formed on an outer periphery of the rotor;

a plurality of vanes, each of the vanes being housed in a corresponding one of the slits in a manner of being capable of protruding from, and retracting in, the slit and having both end faces formed into curved surfaces in a plane perpendicular to a rotational axis of the rotor;

a cam ring oscillatably disposed so as to surround the rotor;

a pump body for housing therein the cam ring, the rotor, and the vanes, the pump body having a surface disposed to face axial side surfaces of the cam ring and the rotor, the surface forming, in addition to the cam ring, the rotor, and the vanes, a plurality of pump chambers thereon, the surface having a suction port communicating with a suction zone in which each of the pump chambers has a volume that increases with rotation of the rotor, a suction side back pressure port introducing pressure common to that of the suction port and communicating with proximal end portions of the slits that house the vanes positioned in the suction zone, a discharge port communicating with a discharge zone in which each of the pump chambers has a volume that decreases with rotation of the rotor, and a discharge side back pressure port introducing pressure common to that of the discharge port and communicating with proximal end portions of the slits that house the vanes positioned in the discharge zone;

a recess formed in an end portion of the rotor axially opposite to the surface in which the suction side back pressure port and the discharge side back pressure port are formed;

a vane cam disposed in the recess such that an outer peripheral surface thereof contacts the proximal end portions of all vanes to thereby forcedly make the vanes protrude and retract, the vane cam being movable so as to vary an amount of eccentricity relative to the drive shaft; and a cam port formed in a surface of the pump body on a side in abutment with the vane cam, the cam port communicating with the recess in the rotor in which the vane cam is housed, wherein the vane cam partitions the proximal end portions of the slits that house the vanes positioned in the suction zone from the proximal end portions of the slits that house the vanes positioned in the discharge zone.

2. The vane pump according to claim 1, wherein each of the curved surfaces of the both end faces of the vane has curvature having a center coinciding with each other.

3. The vane pump according to claim 1, wherein each of the curved surfaces of the both end faces of the vane has curvature having a center disposed on a vane distal end side relative to a center of an axial length of the vane.

4. The vane pump according to claim 2, wherein each of the curved surfaces of the both end faces of the vane has curvature having a center disposed on a vane distal end side relative to a center of an axial length of the vane.

5. The vane pump according to claim 1, wherein each of the curved surfaces of the both end faces of the vane has a center disposed at a center of an axial length of the vane.

6. The vane pump according to claim 2, wherein each of the curved surfaces of the both end faces of the vane has a center disposed at a center of an axial length of the vane.

7. The vane pump according to claim 1, wherein each of the curved surfaces of the both end faces of the vane has curvature having a center disposed on a vane proximal end side relative to a center of an axial length of the vane.

8. The vane pump according to claim 2, wherein each of the curved surfaces of the both end faces of the vane has curvature having a center disposed on a vane proximal end side relative to a center of an axial length of the vane.

* * * * *